US007722367B2

(12) United States Patent
Jong

(10) Patent No.: US 7,722,367 B2
(45) Date of Patent: May 25, 2010

(54) APPARATUS FOR DISTRIBUTING ELECTRICAL POWER AND/OR COMMUNICATION SIGNALS

(75) Inventor: Choon Jong, Singapore (SG)

(73) Assignee: Nutek Private Limited, Joo Koon Circle (SG)

( * ) Notice: Subject to any disclaimer, the term of this patent is extended or adjusted under 35 U.S.C. 154(b) by 0 days.

(21) Appl. No.: 12/181,754

(22) Filed: Jul. 29, 2008

(65) Prior Publication Data

US 2009/0047838 A1 Feb. 19, 2009

Related U.S. Application Data

(62) Division of application No. 11/682,143, filed on Mar. 5, 2007, now Pat. No. 7,481,658, which is a division of application No. 10/510,965, filed as application No. PCT/SG03/00100 on Apr. 30, 2003, now Pat. No. 7,201,589.

(30) Foreign Application Priority Data

May 8, 2002 (SG) ..... 200202742
Jan. 10, 2003 (SG) ..... 200300071

(51) Int. Cl.
*H01R 25/00* (2006.01)

(52) U.S. Cl. ..... 439/118

(58) Field of Classification Search ..... 439/118, 439/122, 121, 119, 117, 120
See application file for complete search history.

(56) References Cited

U.S. PATENT DOCUMENTS 4,139,252 A 2/1979 Gorny
4,243,284 A 1/1981 Humphreys
4,720,768 A 1/1988 Schindele
5,167,516 A 12/1992 Tan et al.
5,418,328 A 5/1995 Nadeau
5,688,132 A 11/1997 Rogers et al.
5,759,051 A 6/1998 Cancellieri et al.
6,079,992 A 6/2000 Kuchar et al.
6,106,341 A 8/2000 Leach, III
6,496,377 B1 12/2002 Happ et al.
7,094,077 B1 8/2006 Chen
7,481,658 B2 * 1/2009 Jong ..... 439/118
2003/0224636 A1 12/2003 Lorenzen et al.

FOREIGN PATENT DOCUMENTS

EP 0465099 1/1992

(Continued)

OTHER PUBLICATIONS

English language Abstract of TW 43495, May 16, 2001.

*Primary Examiner*—Neil Abrams
*Assistant Examiner*—Phuong Nguyen
(74) *Attorney, Agent, or Firm*—Greenblum & Bernstein P.L.C.

(57) ABSTRACT

In one embodiment, an electrical power distribution apparatus is disclosed which includes a track made up of a plurality of track sections connected together by/to joints and end sections. The track sections are each provided with a slot with which a power point connector may be engaged at any point by inserting a contact member of the connector through the slot at a chosen point and then rotating the connector by 90 degrees to bring the contact member into engagement with electrical conductors of the track. The apparatus may comprise a further conduit containing conductors used to distribute communication signals.

7 Claims, 44 Drawing Sheets

FOREIGN PATENT DOCUMENTS

| | | | |
|---|---|---|---|
| JP | 45-035498 | B | 11/1970 |
| JP | 49-014397 | U | 2/1974 |
| JP | 57-163971 | A | 10/1982 |
| JP | 58-130384 | U | 9/1983 |
| JP | 61-248377 | A | 11/1986 |
| TW | 360602 | | 6/1999 |
| TW | 434956 | | 5/2001 |
| WO | 87/01524 | | 3/1987 |

* cited by examiner

4000

APPARATUS FOR DISTRIBUTING ELECTRICAL POWER AND/OR COMMUNICATION SIGNALS

CROSS REFERENCE TO RELATED APPLICATIONS

The present application is a divisional application of pending U.S. patent application Ser. No. 11/682,143, filed on Mar. 5, 2007, which is a Divisional Application of U.S. patent application Ser. No. 10/510,965, filed on Nov. 1, 2004, now U.S. Pat. No. 7,201,589, which is the National Stage of International Application PCT/SG03/00100, filed on Apr. 30, 2003.

BACKGROUND AND FIELD OF THE INVENTION

This invention relates to apparatus for distributing electrical power and/or communication signals more particularly to an apparatus enabling an electrical power supply and/or communication signals to be provided to an electrical power or communication point respectively.

Communication signals are used in a wide sense in this application to include voice, data, text, image and/or video be it transmitted point-to-point or point-to-multipoint.

The conventional system of electrical power distribution in domestic and commercial environments is provided by power points which are installed in a wall cavity or a surface mounted power outlet at predetermined places. The location of such power points needs to be chosen in advance and often subsequent requirements can mean that the power points are provided in the wrong location and/or in insufficient numbers.

A similar disadvantage is also present for communications points used to distribute voice, data or text, for example.

It is an object of the invention to provide a more flexible apparatus for distributing electrical power and/or communication signals.

SUMMARY OF THE INVENTION

According to the invention in a first aspect, there is provided electrical power supply distribution apparatus comprising a conduit containing at least one elongate conductor, the conduit having an opening through which a connector is able to be inserted to connect electrically with the conductor; and a conductive member disposed between the opening and the conductor and resiliently displaceable by a said connector to provide access to the conductor.

Preferably, the member forms an earth connector and is resiliently biased towards and/or occludes and/or seals the opening and the apparatus may further comprise a displaceable flap for the opening, the member underlying the flap.

The apparatus may be combined with a said connector having an electrical contact arranged to engage the conductor.

According to the invention in a second aspect, there is provided electrical power supply distribution apparatus comprising a conduit containing at least one elongate conductor, the conduit having an opening arranged to receive a connector to connect electrically with the conductor; and a cable run separated from the conductor by an EMI shield.

The shield is preferably formed by at least a part of the conduit and may be formed from metal or as a metallic or metallised layer. The shield may form an earth connector. Preferably the cable run is arranged to receive data and/or communications cables.

According to the invention in a third aspect, there is provided an electrical connector arranged to receive an electrical plug and having first and second electrical contacts arranged to engage corresponding conductors of an electrical power supply distribution apparatus, wherein the contacts are disposed at opposed ends of an arm rotatable between a first position in which the contacts are arranged to disengage from the conductors and a second position in which the contacts are arranged to engage with the conductors.

According to the invention in a fourth aspect, there is apparatus for distributing electrical power and/or communication signals which comprises an elongate conduit containing at least one elongate conductor, the conduit having an elongate opening arranged to receive a connector to connect electrically with the conductor and a resiliently displaceable flap for the opening wherein the flap is co-extruded with a part of the conduit.

Preferably the or each flap is co-extruded with a member forming a side of the opening. The flap and part of the conduit may be co-extruded from the same material but of different hardness. Alternatively, the flap and part are co-extruded from different materials.

According to the invention in a fifth aspect, there is provided a terminal connector arranged to engage a conduit containing at least one elongate conductor and having an opening arranged to receive a power point connector or an electrical plug to connect electrically with the conductor, the terminal connector having means slidably connectable to an end of a said conduit and to said conductor and arranged to connect the conductor to a mains supply or the conductor of another said conduit. If the conduit carries at least a further conductor to distribute data and/or communication signals, then a data and/or communications terminal connector is used to connect to an end of a said conduit and to the further conductor and arranged to connect the further conductor to a data and/or communications cable for providing communication signals.

Preferably, two connectors of the fifth aspect may be combined and connected together so that said means project outwardly so as to be connectable to adjacent said conduits.

According to the invention in a sixth aspect there is provided electrical power distribution apparatus comprising: a metal conduit containing at least one elongate conductor, the conduit having an opening arranged to receive a connector to connect electrically with the conductor; and the conductor being connected to the conduit via an insulator, whereby the conduit forms an EMI shield for the conductor.

In a variation of the third aspect, an electrical plug may be arranged to be coupled directly with an electrical power supply distribution apparatus which forms an independent seventh aspect of the present invention and which provides an electrical plug arranged to receive one or more electrical wires for coupling to an electrical device, the plug having first and second electrical contacts arranged to engage corresponding conductors of an electrical power supply distribution apparatus, wherein the contacts are disposed at opposed ends of an arm rotatable between a first position in which the contacts are arranged to disengage from the conductors and a second position in which the contacts are arranged to engage with the conductors.

According to the invention in an eighth aspect, there is provided communications signal distribution apparatus comprising a conduit containing at least one elongate conductor, the conduit having an opening arranged to receive a data and/or communications connector to connect electrically with the conductor. In this way, the apparatus is arranged to distribute voice, data, text to an communications device connected to the connector.

According to the invention in a ninth aspect, there is provided apparatus for distributing electrical power and/or communication signals, the apparatus comprising two conduits separated by an EMI shield, each conduit containing at least one elongate conductor and which includes an opening arranged to receive a conductor to connect electrically with the conductor.

Preferably, one conduit is used to distribute voice, data or text and the other conduit is used to distribute electrical power. If one of the conduit is used to distribute electrical power, then the apparatus further comprises a conductive member in the conduit which is being disposed between the opening and the conductor of the conduit and being resiliently displaceable by a the connector to provide access to the conductor of the conduit.

According to the invention in a tenth aspect, there is provided an electrical socket comprising a housing containing at least one conductor, the housing having an opening through which a connector is able to be inserted to connect electrically with the conductor, and a conductive member disposed between the opening and the conductor and resiliently displaceable by a said connector to provide access to the conductor.

According to the invention in a eleventh aspect, there is provided an extension cable including the invention(s) of any of the preceding aspects.

BRIEF DESCRIPTION OF THE DRAWINGS

Embodiments of the invention will now be described by way of example with reference to the accompanying drawings in which.

DETAILED DESCRIPTION OF THE PREFERRED EMBODIMENTS

Figure 1:
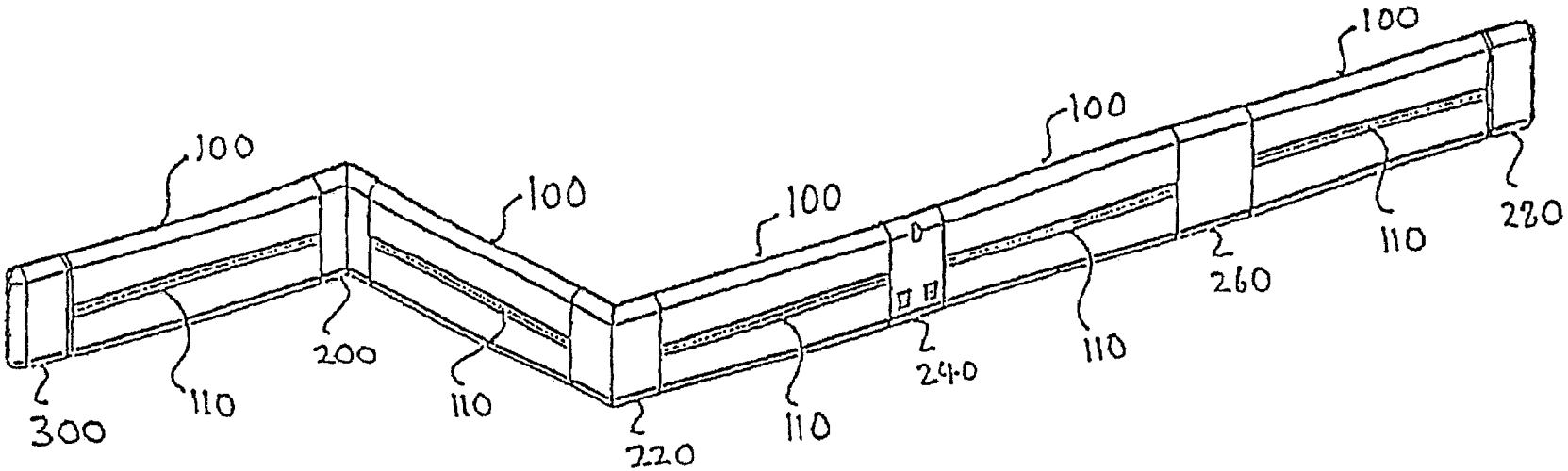
FIG. 1 is a three dimensional view of a track of a first embodiment of power supply apparatus of the invention.
Figure 2:
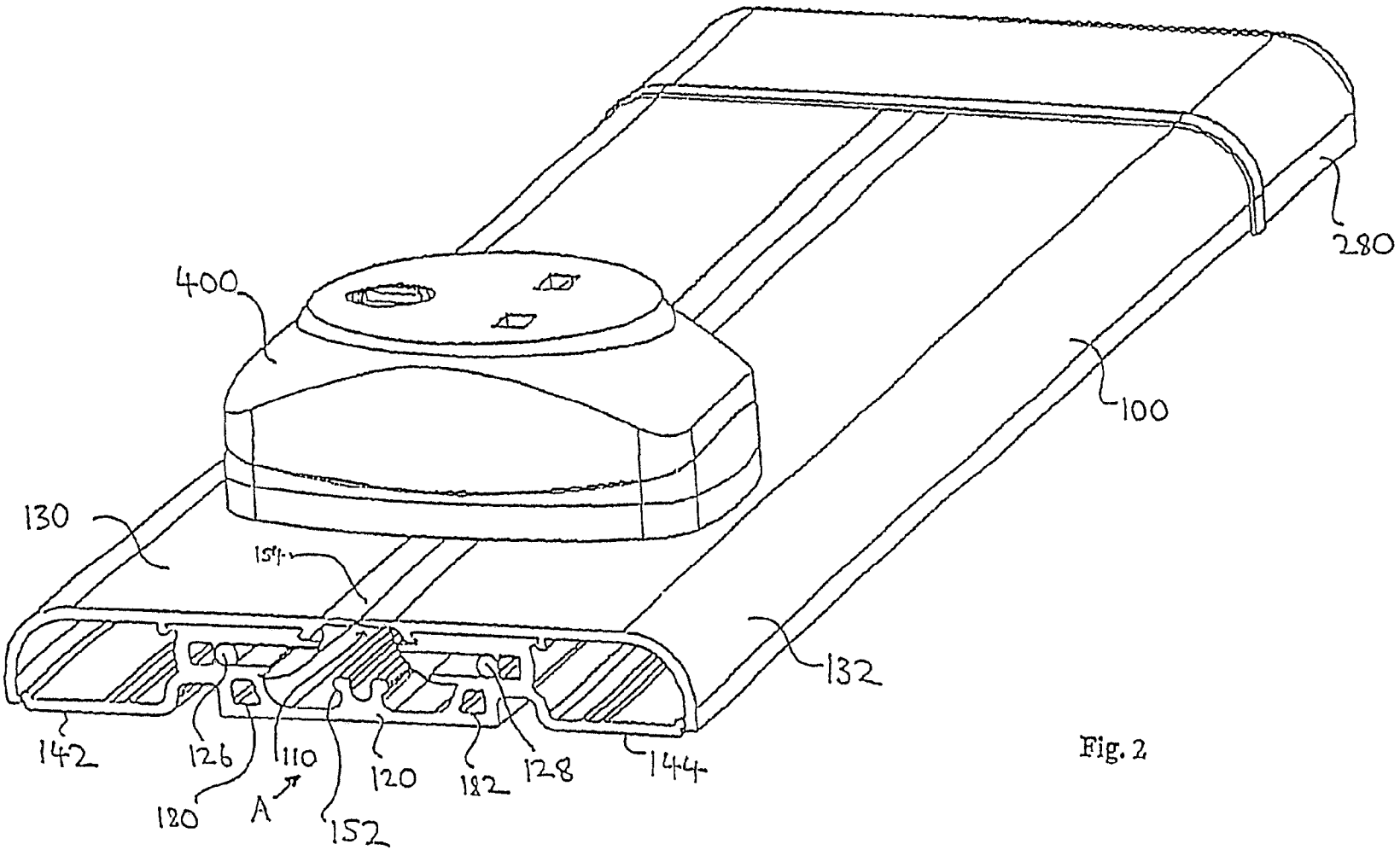
FIG. 2 is an enlarged view of a track section of the embodiment of FIG. 1 showing a power point connector connected to the track section.

With reference to FIGS. 1 and 2, general views of the elements of an embodiment of the apparatus of the invention are shown. The apparatus provides a means for selecting a position in which power points may be placed thus allowing flexibility in position and/or number of power points which may be provided. A track is shown in FIG. 1 and comprises a plurality of identical track sections 100, each having a slot 110, connected together by means of joints 200-260 and end connectors 280, 300. Within the connectors 200-300 are provided power supply/connection units described hereafter which connect the track as a whole to the electrical mains supply and provide electrical continuity between track sections 100. Joint 240 also provides an interface to data and/or communication cables which run through the track as will be described below. At any point along slots 110, one or more power point connector(s) 400 may be engaged with a track section 100 to provide a supply connection between the power supply connected to the track and a device to be plugged into the or each connector 400.

With reference to FIGS. 2-6 a track section 100 is shown in more detail and comprises a conduit formed from an elongate extruded plastics base 120 which includes cavities 122, 124 each for receiving an elongate cylindrical conductor 126, 128, each cavity 122, 124 being provided with arcuate portions for engaging the sides of each conductor 126, 128 in a snap-fit arrangement. First and second cover members 130, 132 which clip to base member 120 via formations 134, 135, 136, 138, 139, 140 are also provided. The cover members 130, 132 together with portions 142, 144 of the base member 120 form elongate enclosures 146, 148 which provide cable runs. The cavities 122, 124 together meet in a central cavity 150 which has an opening forming the elongate slot 110. The cover members 130, 132 are provided with elongate deformable plastic flaps 154 which provide a cover for the slot 110.

Figure 6:
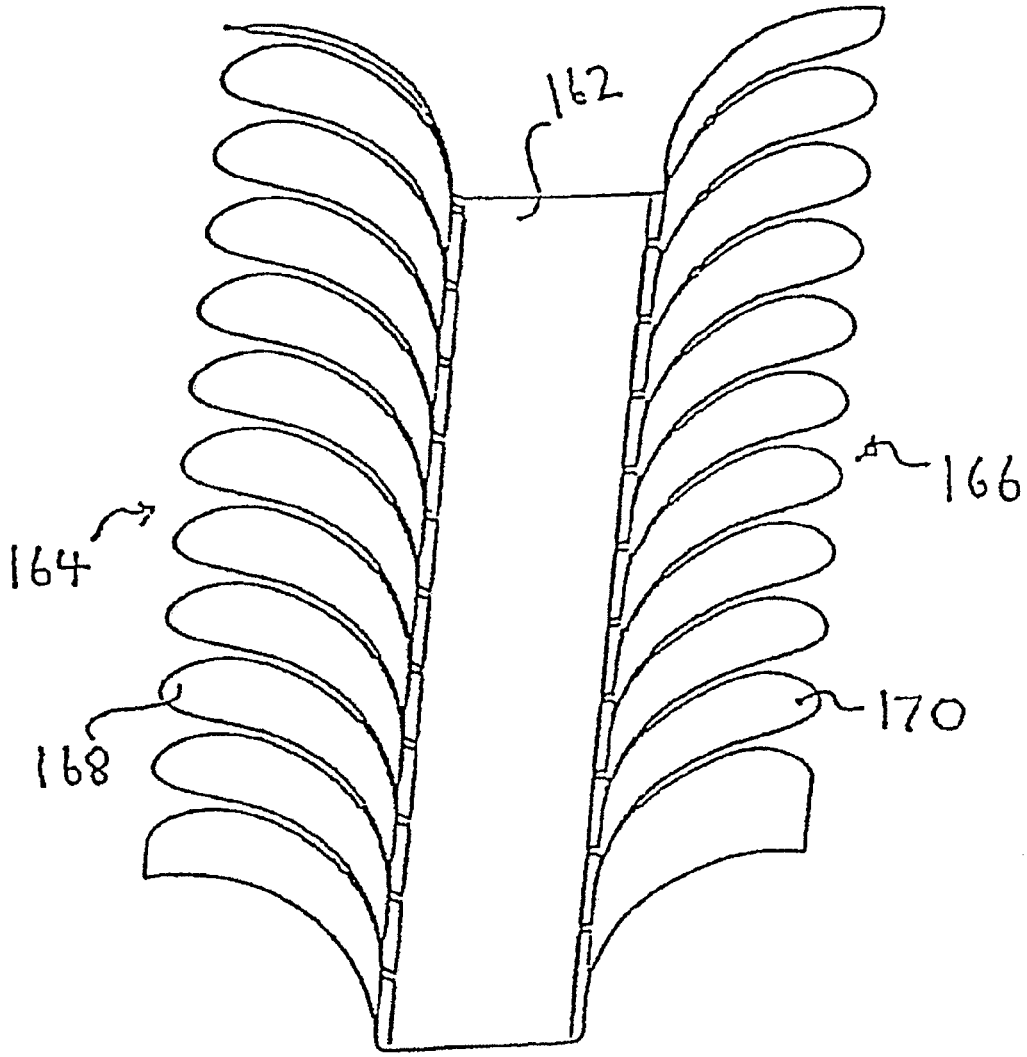
FIG. 6 is an underneath view of the earth spring of FIG. 5.

An earth spring 160 formed from flexible, resilient conductive material is provided in the cavity 150. The earth spring 160 is connectable to earth and has a flat, elongate, sheet-like central portion 162 with wings 164, 166 projecting arcuately away from the portion 162. Each wing 164, 166 is divided into a plurality of wing members 168, 170 individually attached to the portion 162 as shown in FIG. 6. The wings 164, 166 rest in elongate slots 172, 174 which hold the ends of the wings in position. The surface 162 projects outwardly to cover slot 110 just below flaps 154. The cavities 122, 124 further have projecting edges 176, 178 which engage the sides of wings 164, 166 and provide further support for the earth spring 160. The earth spring 160 is locally resiliently displaceable from the position shown in FIG. 2 to a position in which the central portion 162 is depressed downwardly to, in the limit, abut against a projection 152 of the base 120. In this position, the ends of the wings 164, 166 remain in the elongate slots 172, 174. The earth spring 160 in this position allows access to the electrical conductors 126, 128 by the power point connector 400.

Each portion 142, 144 is provided with a plurality of openings 143 to allow fixing of the track section 100 to a supporting surface. The base further includes elongate channels 180, 182 for receiving connector lugs as will be described hereinafter.

The base 120 and covers 130, 132 are formed from extruded plastic materials, for example PVC or PP (Polypropylene). The flaps 154 are co-extruded with the covers 130, 132 and are formed from the same material but of lower hardness. The cylindrical conductors 126, 128 are preferably formed from copper with the earth spring 160 being formed from a conductive spring material, preferably an alloy such as beryllium copper or phosphorous bronze.

Figure 7:
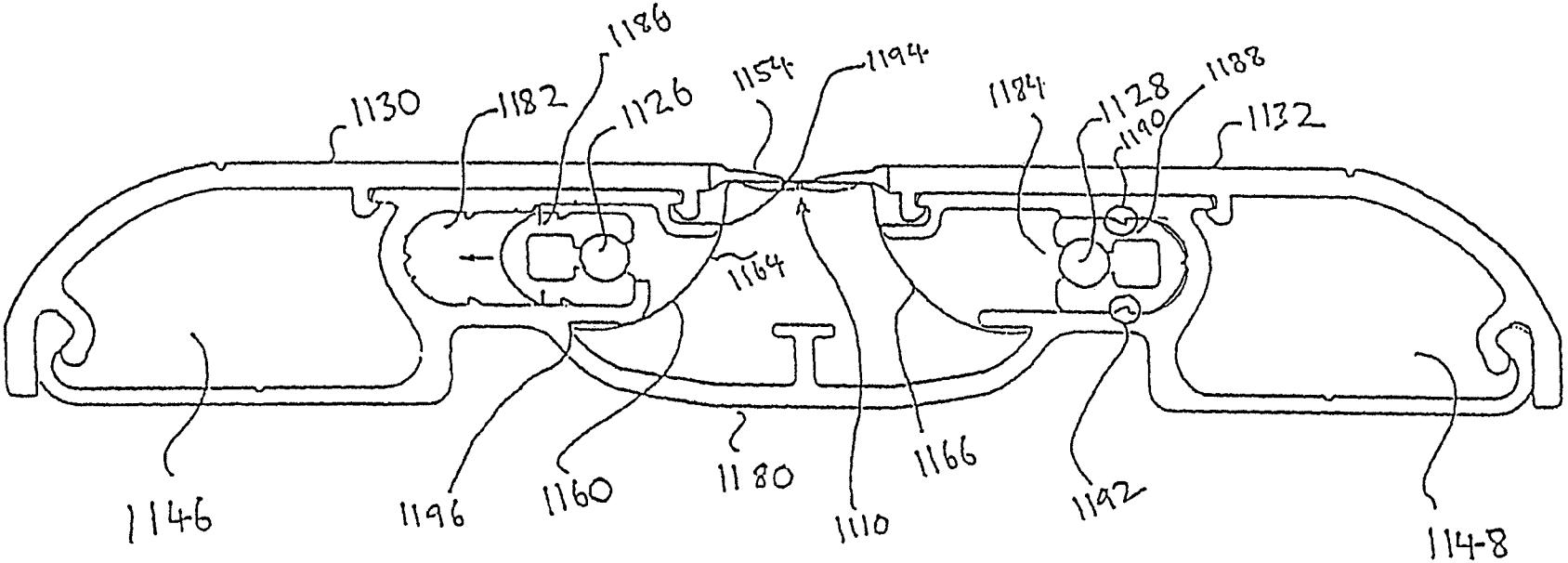
FIG. 7 is a cross-sectional view similar to FIG. 3 of a track section of a second embodiment of the invention.

A second embodiment of track section 100 is shown in FIG. 7. This is generally similar to that described with reference to FIGS. 1-6 and similar parts have similar reference numerals with the addition of 1000. The essential difference between this embodiment and that of the previous figures concerns the base member 1180 which instead of being extruded from plastics material is extruded from metal, preferably aluminium. Each conductor 1126, 1128 is disposed in a cavity 1182, 1184 slightly differently shaped compared to the first embodiment via an elongate insulating member 1186, 1188. The insulating members 1186, 1188 are extruded from PVC or PP and are a snap-fit in the cavities 1182, 1184, held in place by co-operating formations ringed at 1190 and 1192. Insulating member 1188 is shown snapped in place in cavity 1184 with member 1186 removed from the cavity 1182. The insulating members 1186, 1188 have opposed jaws which hold the conductors 1126, 1128 in place. In use, the metal extrusion forming the base 1180 and the cavities 1192, 1194 provides an EMI shield between the conductors 1126, 1128 and the data and telecommunications cable runs 1146 and 1148. The EMI shield is further enhanced by the wings 1164, 1166 of the earth spring 1160 which contact the metal base member 1180 at points 1194, 1196 to form a conductive loop around the conductor. The base member 1180 is preferably connected to earth as well as or instead of the earth spring 1160, so that the combination of earth spring and base provides earth protection.

Figure 7A:
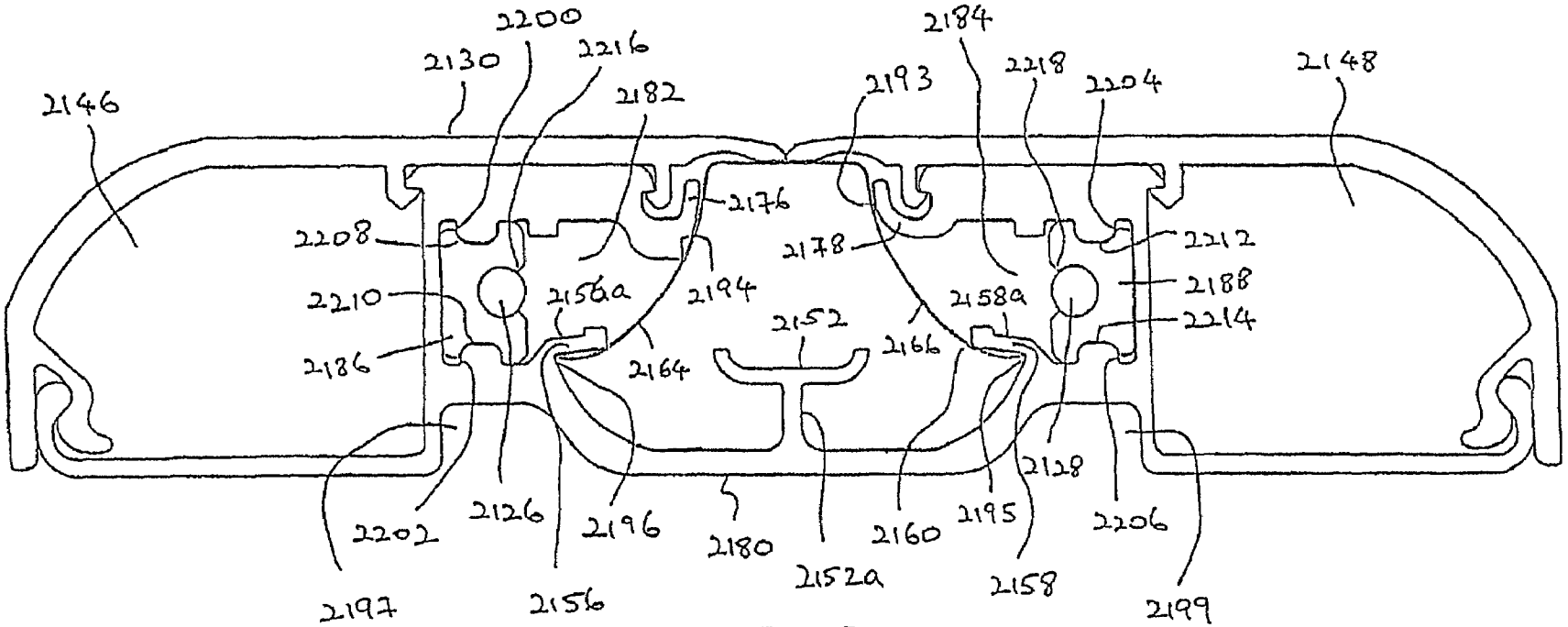
FIG. 7*a* is a cross-sectional view of a variation of the second embodiment shown in FIG. 7 and which forms a third embodiment of the invention.

A third, preferred embodiment of the track section 100 is shown in FIG. 7*a*. This is generally similar to the second embodiment and similar parts have similar reference numerals with the addition of a further 1000. The main difference between the second and third embodiments is the structure of the base member 2180 which is also extruded preferably from aluminium. Each conductor 2126, 2128 is disposed in a cavity 2182, 2184 slightly differently shaped compared to the second embodiment via an elongate insulating member 2186, 2188 which is also in a different form. The insulating members 2186, 2188 are typically made of the same material as the insulating members 1186, 1188 of the second embodiment and are a friction-fit in the cavities 2182, 2184, held in place by opposing lugs 2200, 2202, 2204, 2206 engaging respective co-operating grooves 2208, 2210, 2212, 2214 in the insulating members 2186, 2188. Each insulating member 2186, 2188 includes an elongate part cylindrical channel 2216, 2218 extending along the length direction of the insulating member 2186, 2188 so that the conductors 2126, 2128 are a sliding fit therein. The projecting edges 2176, 2178 are shaped differently from the previous embodiments and in this embodiment, the edges 2176, 2178 curved upwards towards the cover 2130 to engage the arcuate wings 2164, 2166 of the earth spring 2160. The T-shaped projection 2152 extending from the base is also differently shaped at the ends. In use, the metal extrusion forming the base 2180 and the cavities 2182, 2184 provides an EMI shield between the conductors 2126, 2128 and the data and telecommunications cable runs 2146, 2148 similar to the second embodiment. The enhancement effect is also provided by conductive loops formed by the wings 2164, 2166 of the earth spring 2160 and respective contact points 2193, 2194, 2195, 2196.

In a further variation, a plastic extrusion provided with a metal conductive film may be used for the second and third embodiments of the apparatus of the invention instead of a metal extrusion. In a further alternative, a plastic extrusion of a first embodiment may be used with a conductive paint or film covering the internal surfaces of the or each cable run 146, 148.

The power point connector 400 shown in FIG. 2 will now be described with more details with reference to FIGS. 8 and 9. The connector includes a cover 410 with openings 412, 414, 416 of a standard UK type three pin plug arrangement, although this, and the supporting mechanism, could be changed to any suitable plug/socket system. The cover 410 and a base 418 together form a housing. The base 418 has a generally circular opening 419 formed therein. A flange member 420 rests in the opening 419 held axially in place against the rim of the opening 419 by snap-fit catch 421 but rotatable relative to the rim. The flange member 420 has itself a circular opening 422 and is provided with radially inwardly extending contact protection members 424, 426 best shown in FIG. 9.

Figure 3:
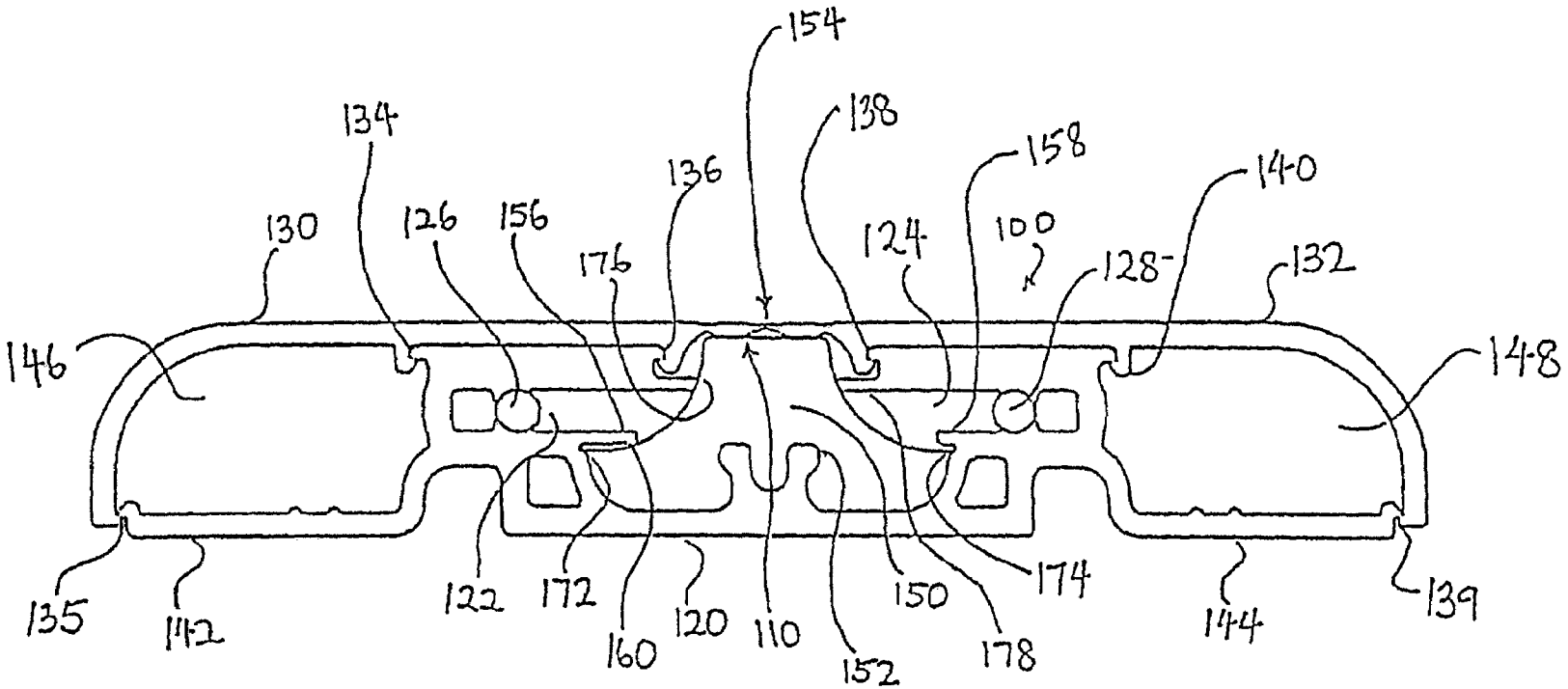
FIG. 3 is a view of the track section in direction of the arrow A of FIG. 2.
Figure 4:
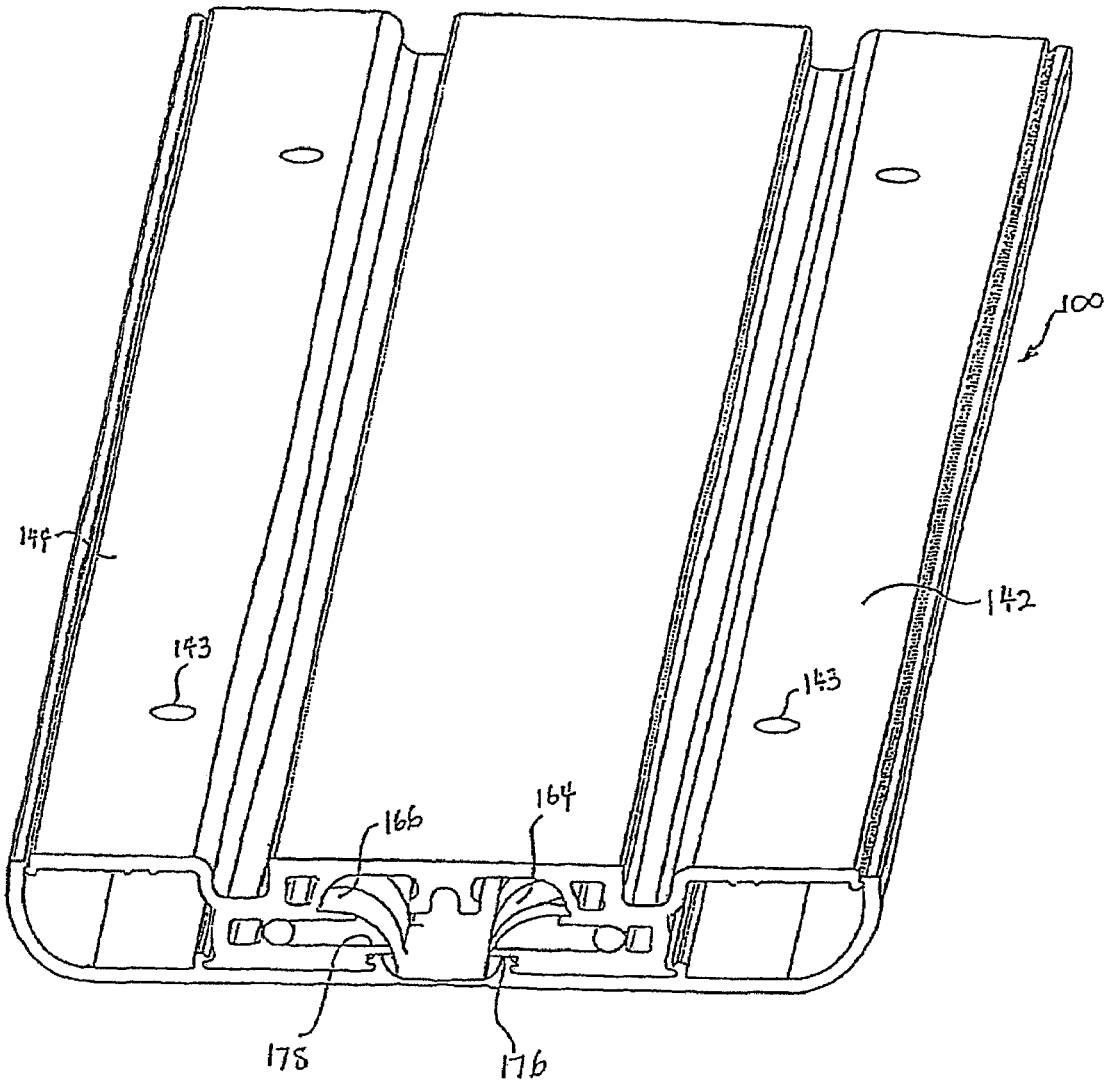
FIG. 4 is an underneath three-dimensional view of the track section of FIG. 2.
Figure 5:
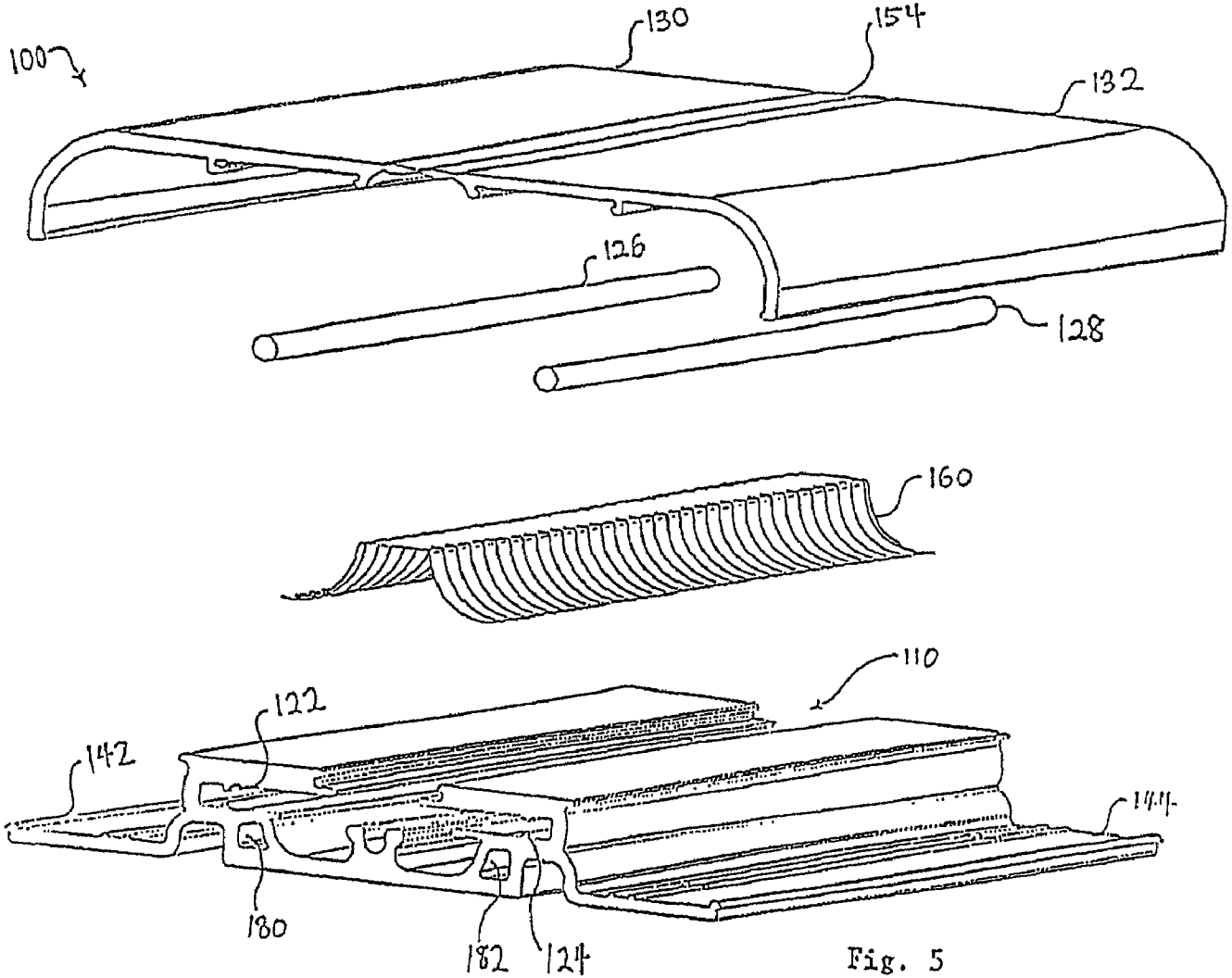
FIG. 5 is an exploded perspective view of part of the track section of FIG. 2.

An electrical contact mounting member 430 is snapped on in opening 422. The member 430 has a cylindrical bearing portion 432 connected to a larger cylindrical flange 434. The bearing portion 432 rests in opening 422 with the flange 434 being supported by the edge of the opening. Connected to the bearing portion 432 is a contact arm 441 which is provided with contact holders 436, 438 at each end. The contact arm 441 is further provided with a raised section 435 extending only part of the length of the arm, offset relative to the axis of rotation of the arm. As shown in FIG. 3, in the second embodiment, the cavities 122, 124 are each provided with an inwardly projecting surface 156, 158 of a different length. The surfaces 156, 158 and projection 435 co-operate to allow only rotation of the arm 441 in one direction and not the other to ensure that a desired polarity of connection between the contact arm 441 and the conductors 126, 128 is maintained.

In the third embodiment of FIG. 7*a*, the rotation of the arm 441 is limited to one direction by the uniquely shaped projecting edges 2176, 2178 which are at different heights relative to the base 2180. The thickness of the contact arm 441 would also be adapted such that one end is thicker than the other (not shown) so that the contact arm 441 can only rotate in one direction and prevented from rotating in another direction by the lower edge 2176.

Each electrical contact holder 436, 438 is of a hook form, the tail of the hook being connected to the remainder of the arm 441 and the head being spaced from but resiliently displaceable towards the remainder of the arm. The length of the arm is such that when contact is made with the conductors 126, 128 there is a slide interference fit, so that the contact portions 436, 438 deform to give a pressing electrical contact.

The flange 434 provides a platform for a contact engaging formation 440 which holds live and neutral contacts 442, 444 in place. Each contact 442, 444 includes a pair of opposed arms 446, 448 which are arranged to receive a pin of a mains plug in sliding engagement when inserted through respective openings 414, 416. Arms 446 are connected via a series of angular elements to contacts 450, 452 which engage around the outside of the contacts supporting portions 436, 438 as is best illustrated in FIG. 9*b*.

Earth connection 454 protrudes out of flange 434 and freely makes electrical contact with earth spring 160 once the power point connector 400 is pushed through slot 154. In the embodiment of FIG. 7, the earth spring provides a bridge between the earth connection 454 and the aluminium base member 1180 which provides a further earth shield.

A shutter member 460 for closing off socket openings 414, 416 is provided. The shutter member 460 occludes the sockets 414, 416, overlying the arms 446, 448 of the electrical contacts 442, 444. The shutter member 460 has a spindle 462 which is received within a spring 464 which is in turn mounted between four orthogonal posts 466 of the mounting formation 440. The shutter member 460 has slanting engagement surfaces 468, 470 which when a mains plug is inserted through sockets 414, 416 will cause shutter member 470 to rotate and be depressed away from the path of movement of the plug pins allowing the plug pins to engage with arms 446, 448 to make an electrical connection.

Figure 9A:
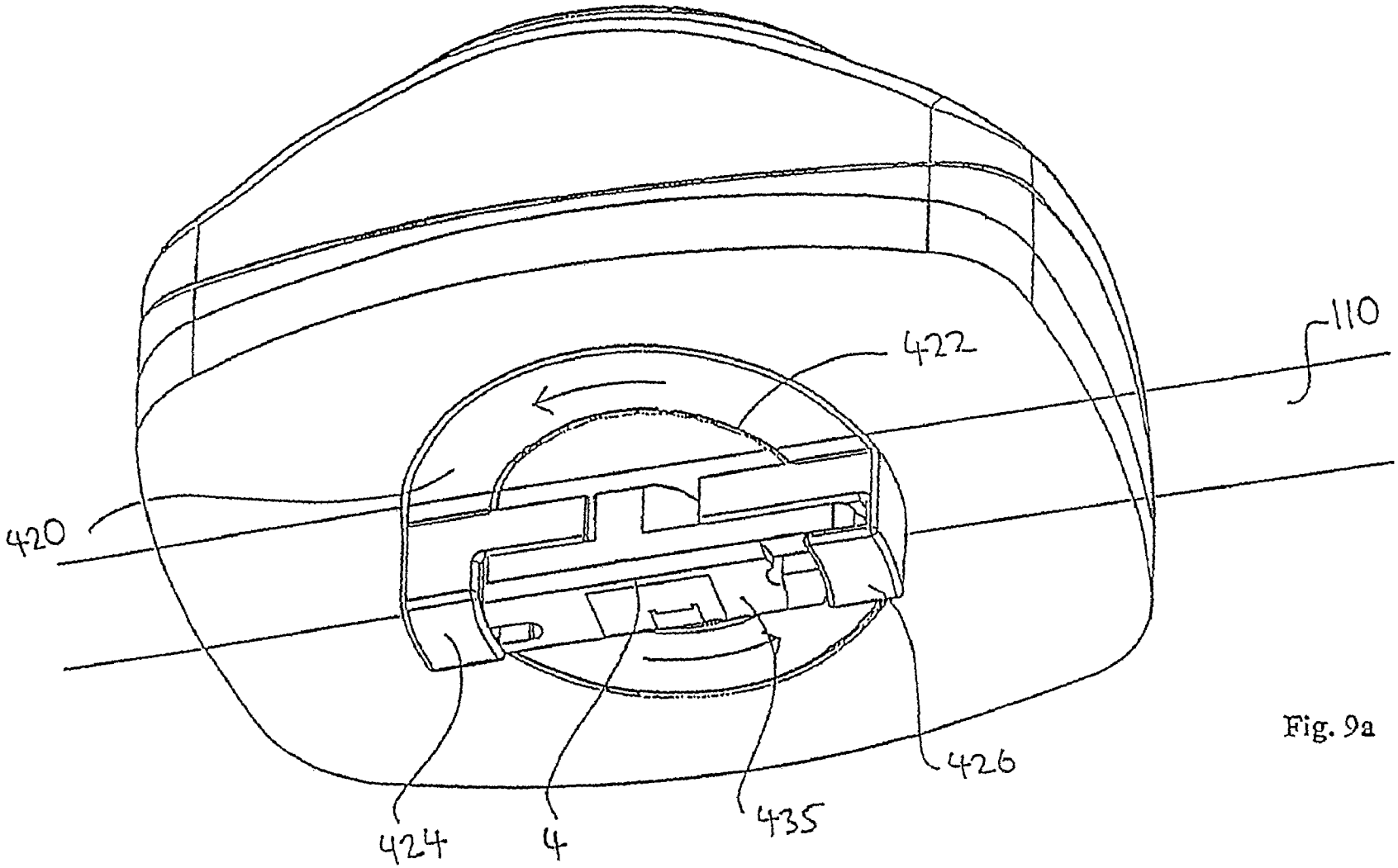
FIG. 9*a* is an assembled view of the connector of FIG. 7 in the first position in which connector is inserted into the slot in the track section and FIG. 9*b* being a similar view of the connector in a second position where the connector engages electrical conductors and earth spring of the track section which are also shown.
Figure 9B:
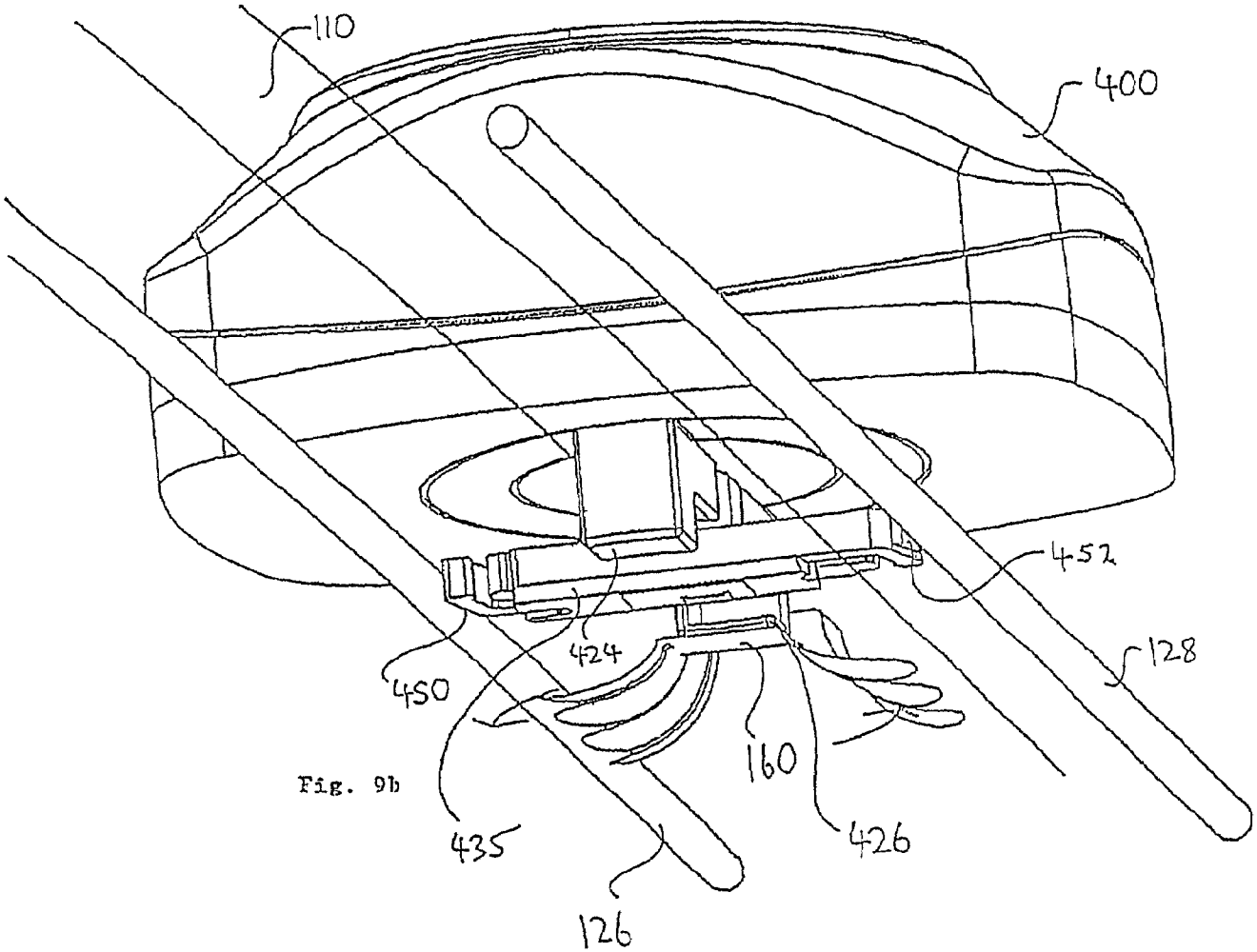

When assembled, the arm 441 projects through opening 422 and is rotatable between the position shown in FIG. 9*a* in which the contacts 450, 452 are covered by protection members 424, 426, and it is in this position that the connector 400 is inserted through slot 152 of track section 100, and the position shown in FIG. 9*b* after 90 degree clockwise rotation in which the contact member is at right angles to the protection members 424, 426. It is in this position that the contacts 450, 452 engage with the conductors 126, 128, with the protection members 424, 426 remaining in the slot 110 and locally depressing the earth spring 160.

Figure 10:
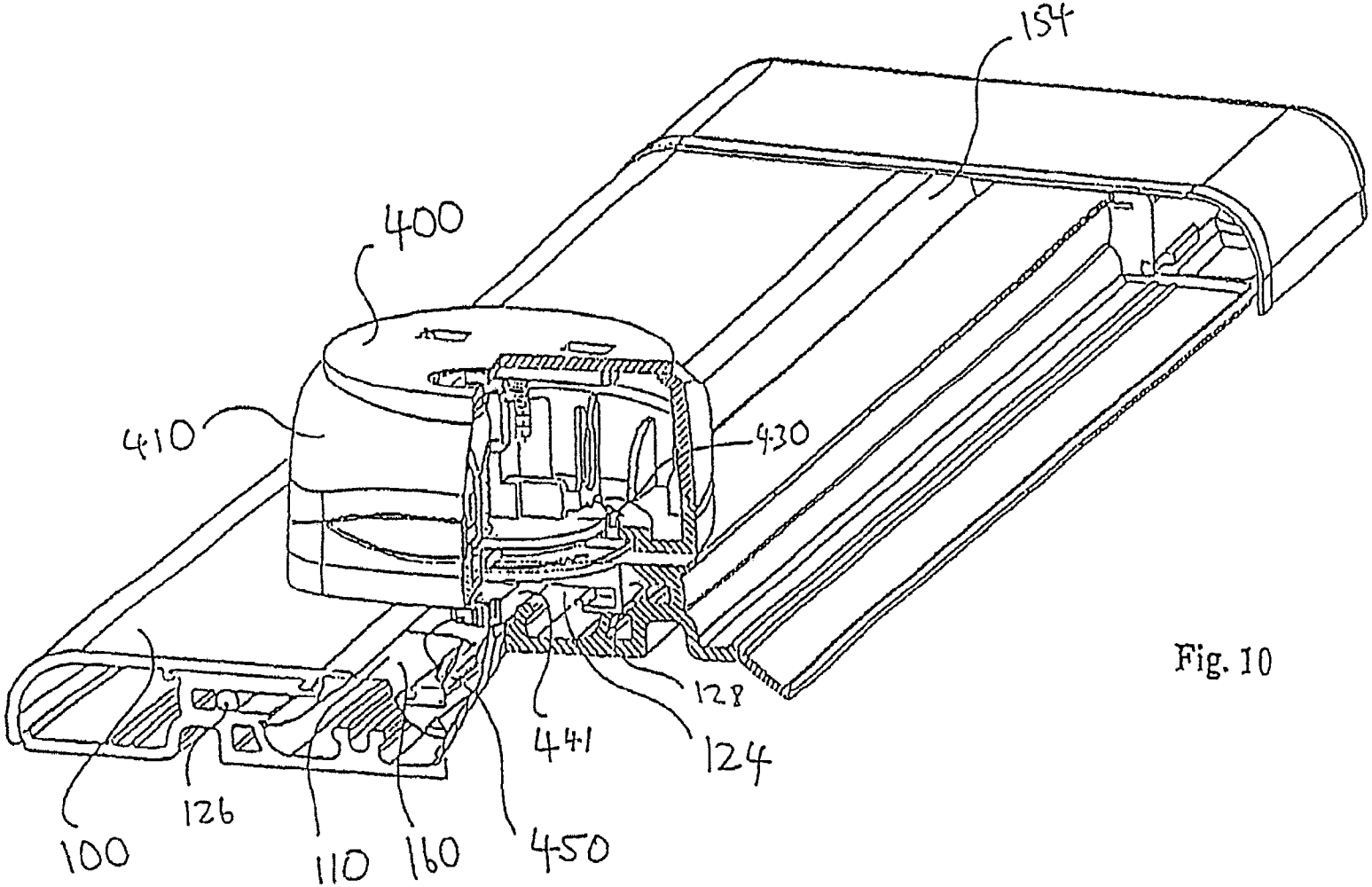
FIG. 10 is a part-section perspective view of the track section and power point connector, with the connector having been inserted into the track section.
Figure 11:
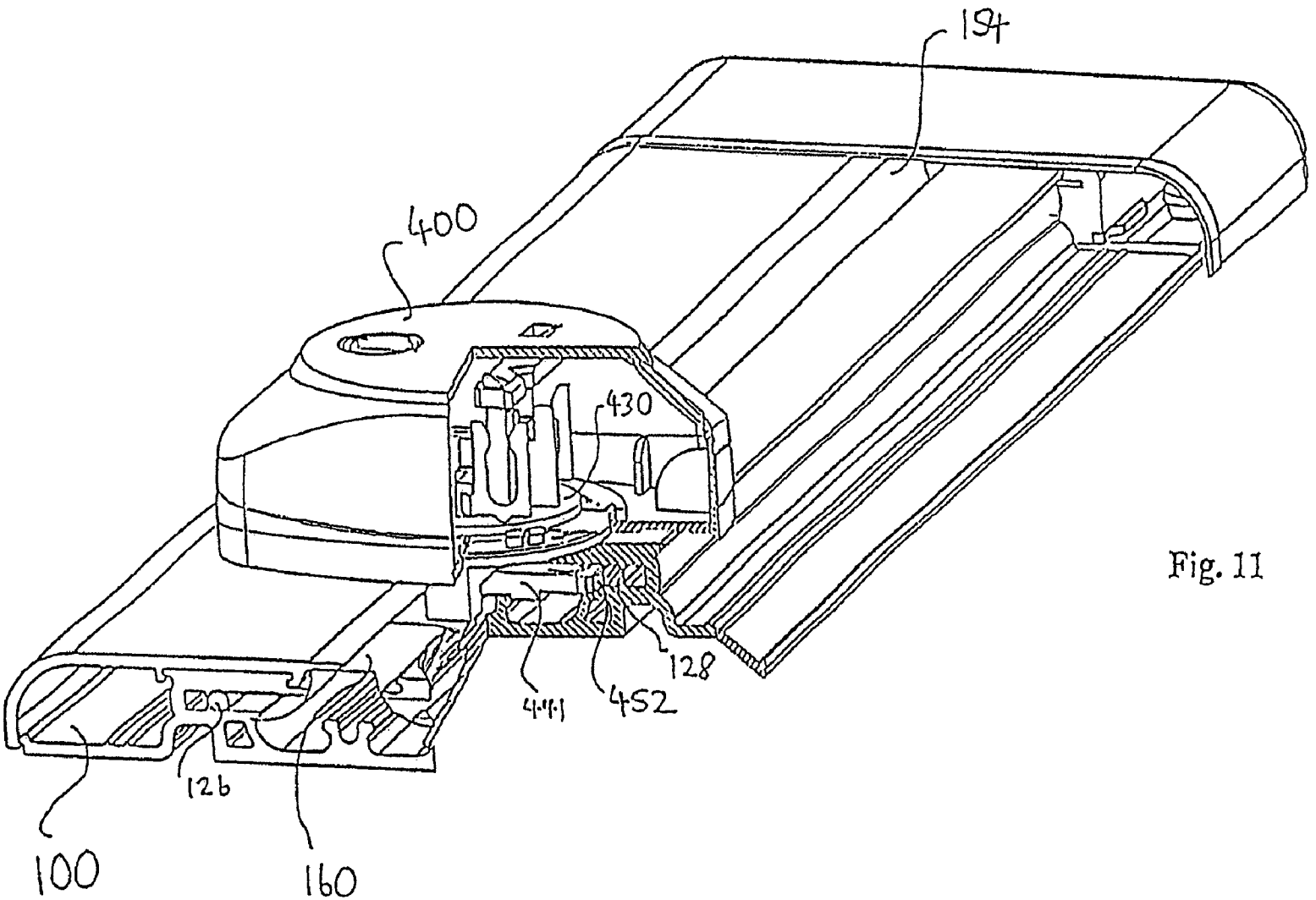
FIG. 11 is a view similar to FIG. 10 showing the power point connector rotated to engage the electrical conductors of the track section.

Operation of the embodiment of the invention will now be described with reference to FIGS. 10 and 11 which are part section views, in FIG. 10, of the power point connector 400 when initially inserted into the track section 100 (see FIG. 3) and, in FIG. 11, subsequently rotated clockwise, electrically to engage the conductors of the track section 100. It is to be understood that the location at which the connector 400 engages the track is chosen by the user in accordance with requirements. Once this location is chosen, the connector 400 is placed in a position shown in FIG. 9*a* with the protection members 424, 426 aligned with slot 110. The connector 400 is then pushed through the cover 154 against the bias of the earth spring 160, pressing this down at the point of entry of the connector 400. The bias of the spring provides a resistance to entry and gives a feeling of positive location of the connectors in the slot to the user. Since the earth spring 160 is formed from flexible material, the spring resiliently deforms only at the point of entry of the connector 400 and remains in a position to cover slot 110 elsewhere. When fully depressed, the cover 410 is then rotated through 90 degrees. The cover, being connected to the rotatable member 430 also causes the arm 434 to rotate through 90 degrees so that this moves from a position in line with slot 152 to a position in which the arm 434 sweeps into cavities 122, 124 until the contacts 450, 452 engage conductors 126, 128 in sliding engagement to provide an electrical path between the conductors 126, 128 and the arms 446, 448. The direction of rotation is dependent on which way the connector is inserted into the slot, since the offset projection 435 will strike surface 158 if the connector is turned the wrong way. Only when turned the right way will the projection 153 not strike the projecting surface 158, thus only allowing connection of the contacts to the correct conductors. Flange member 420 remains in place during this rotation with contact protection members 424, 426 being held in the channel. The engagement of the arm 446, 448 with conductors 126, 128 and the sides of the adjacent cavities lock the power point connector 400 in place at the chosen location. The connector 400 may then be used by any normal electrical power point.

Figure 8:
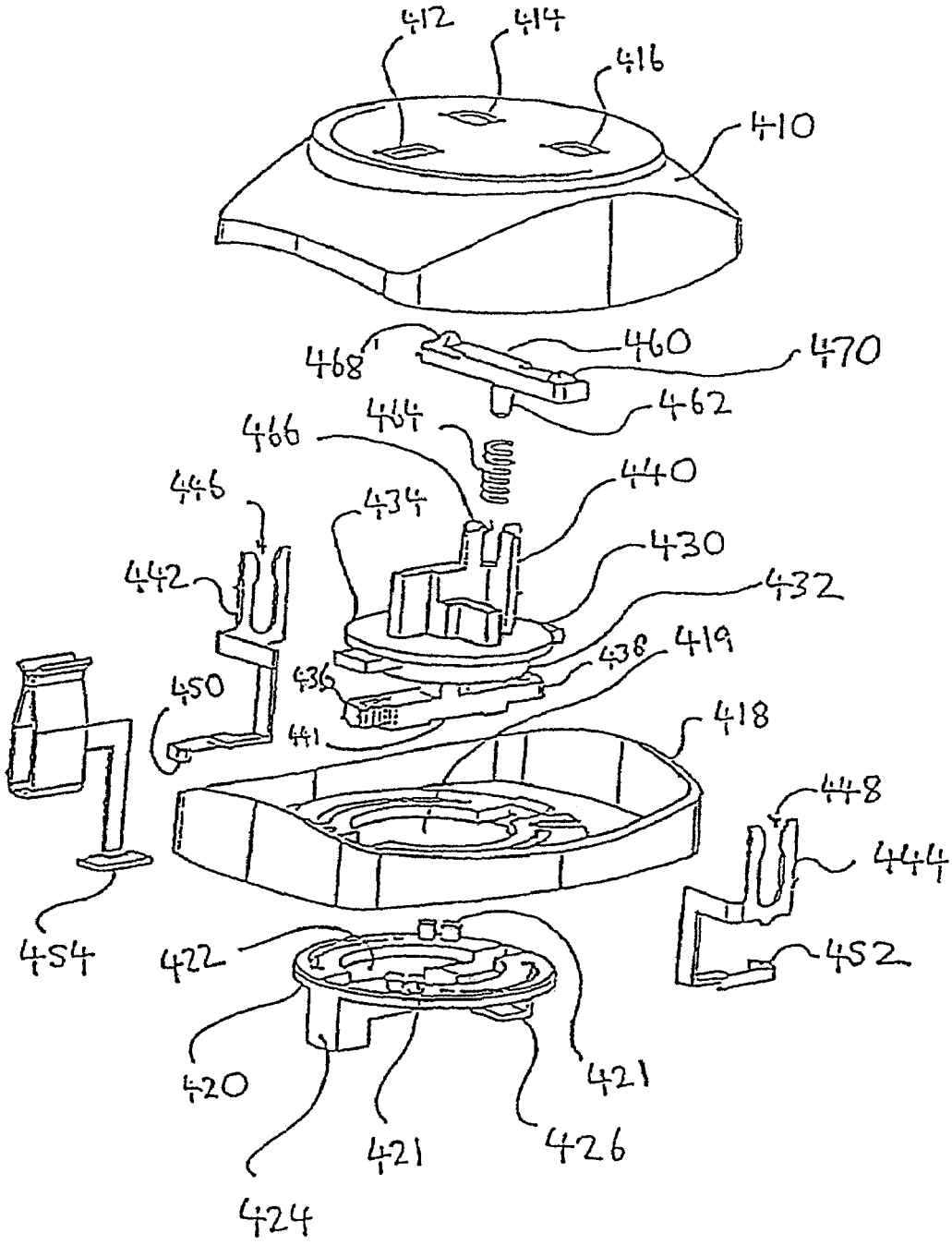
FIG. 8 is an exploded perspective view of the power point connector shown in FIG. 2.
Figure 11A:
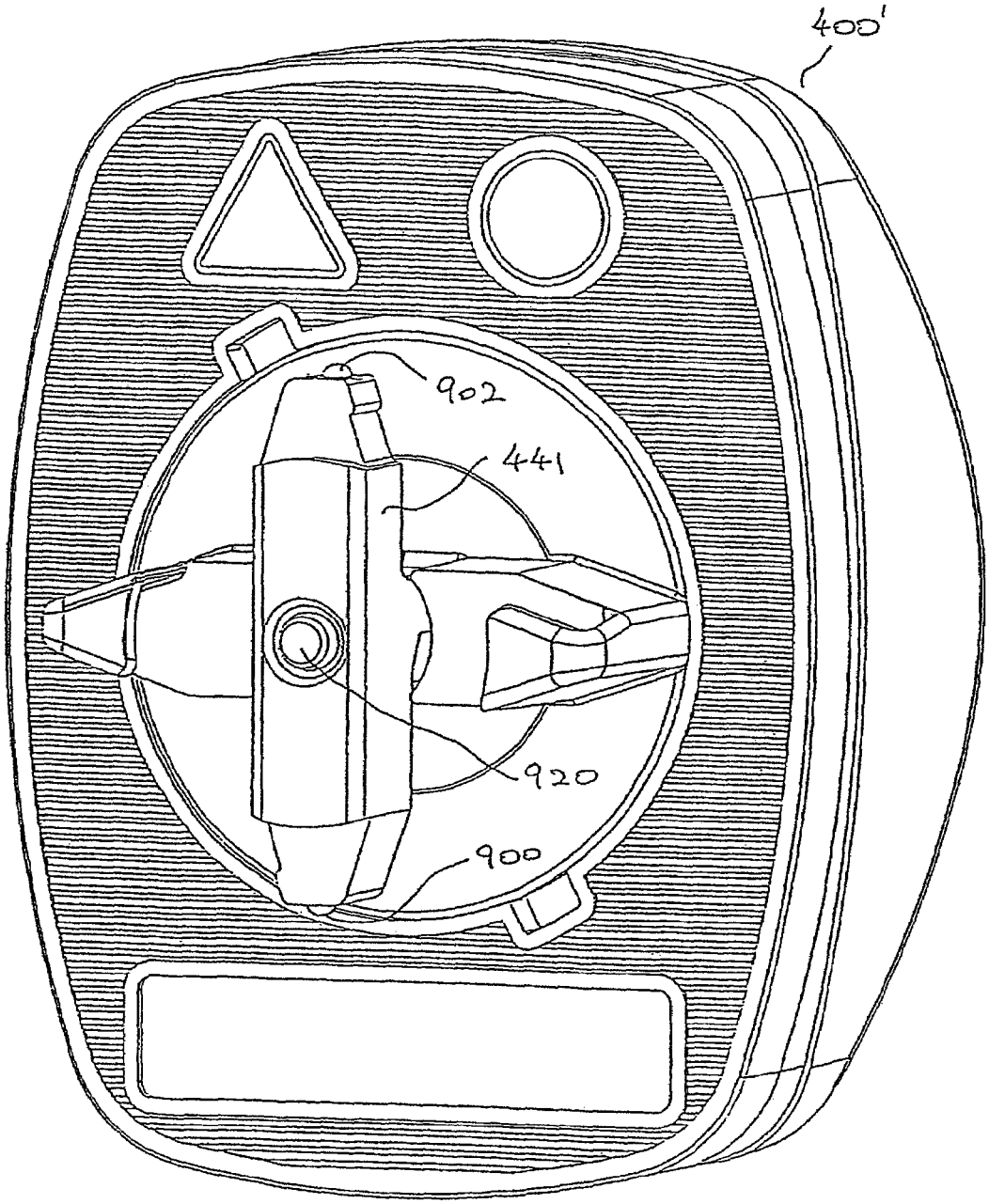
FIG. 11*a* shows a bottom perspective view of another variation of a power point connector.

FIG. 11*a* shows a bottom perspective view of a variation of the power point connector 400' of FIG. 8. In this variation, instead of a hook shape supporting portion at opposed ends of the contact arm 441, a resiliently displaceable hemispheric contact or head 900, 902 is used which is shown more clearly in FIG. 11*b*.

Figure 11B:
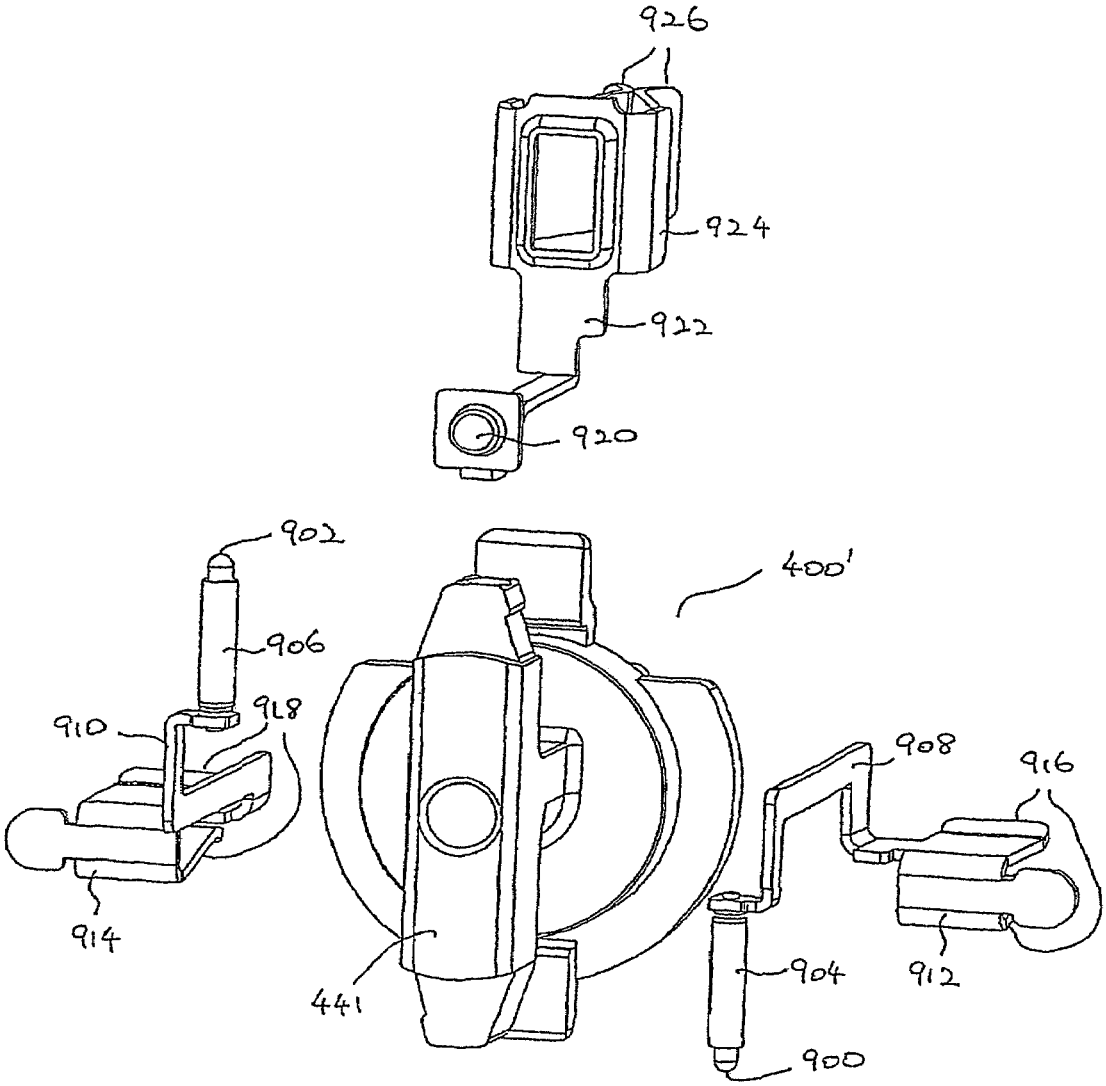
FIG. 11*b* shows an exploded view of part of the power point connector of FIG. 11*a;*

The exploded perspective view of FIG. 11*b* illustrates two heads 900, 902 resiliently displaceable in respective cylindrical holders 904, 906 which in turn are each connected to a series of angular elements 908, 910 that open up into contacts 912, 914. Similar to the contacts 442, 444, each contact 912, 914 includes a pair of opposed arms 916, 918 arranged to receive a pin of a mains plug in sliding engagement when inserted though respective openings 414, 416 (see FIG. 8). When each head 900, 902 engages a respective conductor 2126, 2128, using the third embodiment of the track section 100 as an example, electricity is conducted though the angular elements 908, 910, contact 912, 914 and to the pin of the mains plug.

The earth connection is provided by another engagement surface 920 which protrudes out of the rotating arm 441 when assembled. The engagement surface 920 is electrically connected to another angular element 922 which also opens up to form a contact 924. The contact 924 also has two oppose arms 926 resiliently biased together and is forced open when the earth pin of the mains plug is inserted between the two arms 926 such that the earth pin is in friction fit therewith.

Figure 11C:
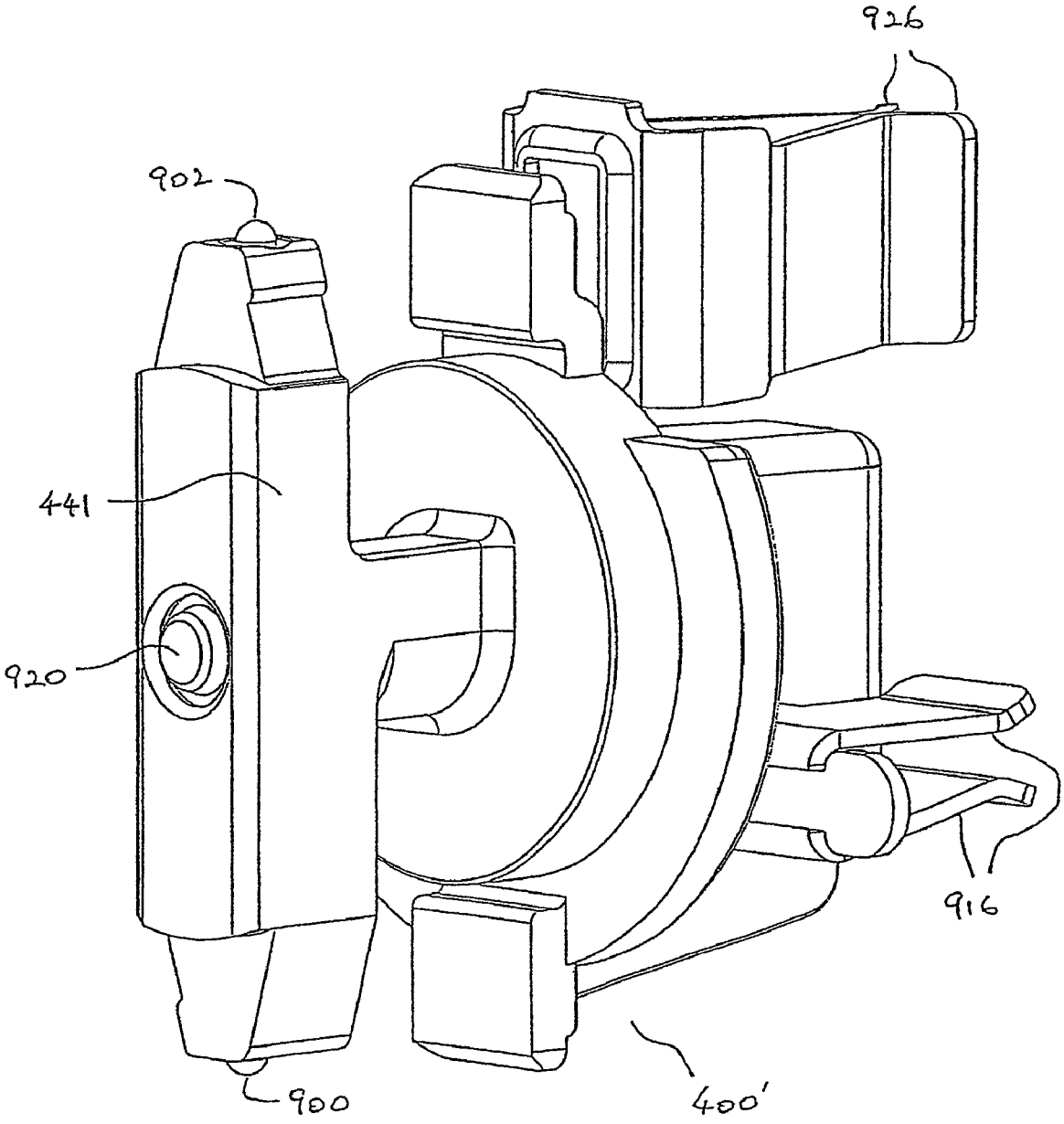
FIG. 11*c* shows the components of the power point connector depicted in FIG. 11*b* being assembled together.

The hemispheric heads 900, 902 and the engagement surface 920 are assembled in the housing of the contact arm 441 and FIG. 11*c* shows this in more detail. As shown the heads 900, 902 and the engagement surface 920 protrudes out at different points of the contact arm 441 with the various contacts 912, 914, 924 facing outwards arranged to receive respective pins of a mains plug. When the connector 400' is inserted through a slot 110 similar to that shown in FIG. 9*a*, the engagement surface 920 sits on the central portion 162 of the earth spring 160 and resiliently biases the central portion 162 towards the base 2180 (using the embodiment of FIG. 7*a* as an example). In this way, electrical contact is formed between earth and the earth pin of the mains plug.

To engage the two conductors 2126, 2128, the connector 400' is similarly rotated 90 degrees (as shown in FIG. 11*a*) so that the heads 900, 902 engage respective conductors 2126, 2128 which resiliently displace the heads 900, 902 inward of the cylindrical holders 904, 906. Thus, electrical contact is made between the conductors 2126, 2128 and the respective neutral and live pins of the mains plug.

Figure 20:
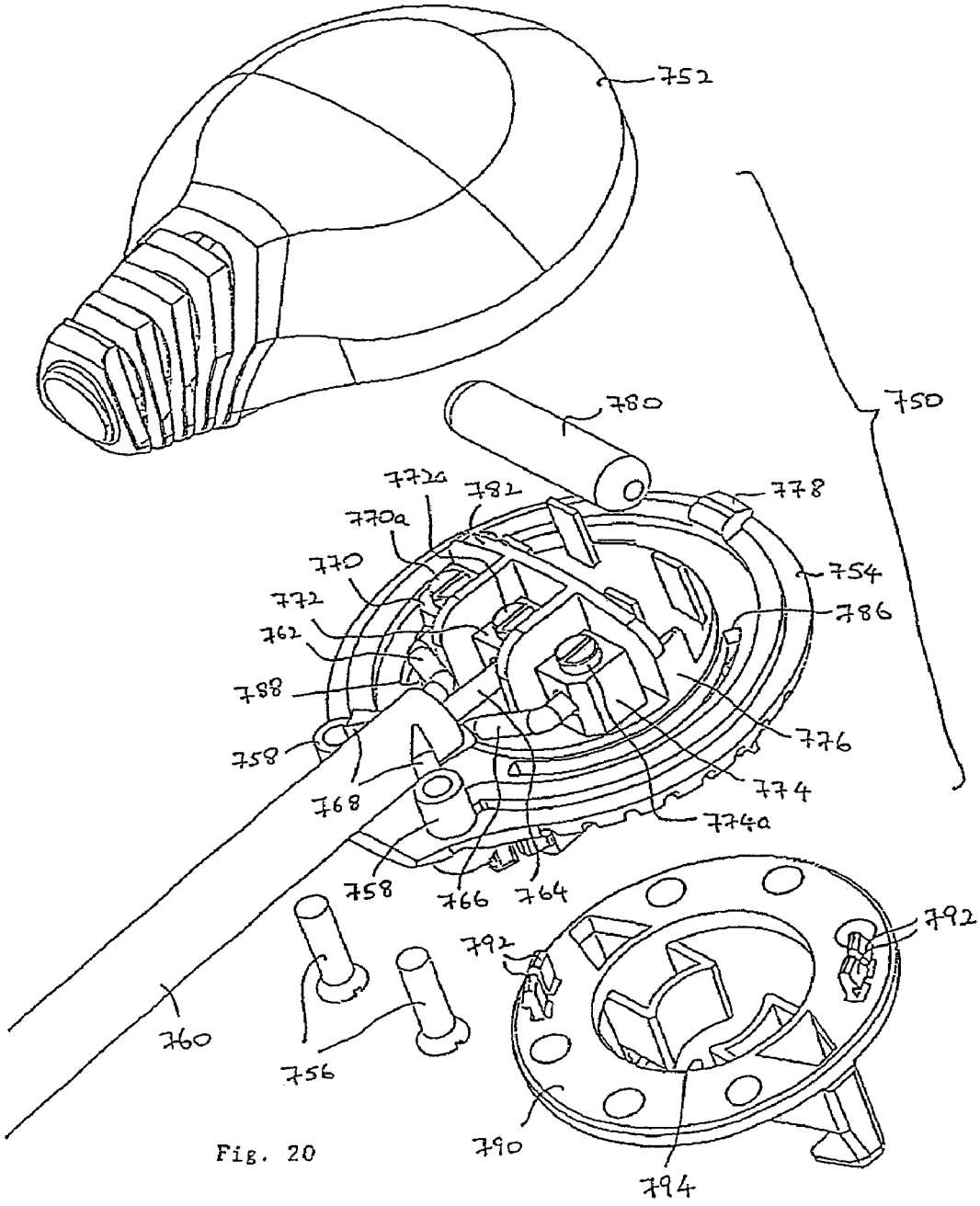
FIG. 20 shows an electrical plug which can be used to connect directly to the track section of FIG. 1 without using the power point connector of FIG. 8.

In one variation instead of a power point connector 400 which allows an electrical device to be connected to the track section 100, the device may be wired directly to an electrical plug for direct connection to the track section 100 and FIG. 20 shows an exploded view of an embodiment of the plug 750.

Figure 20A:
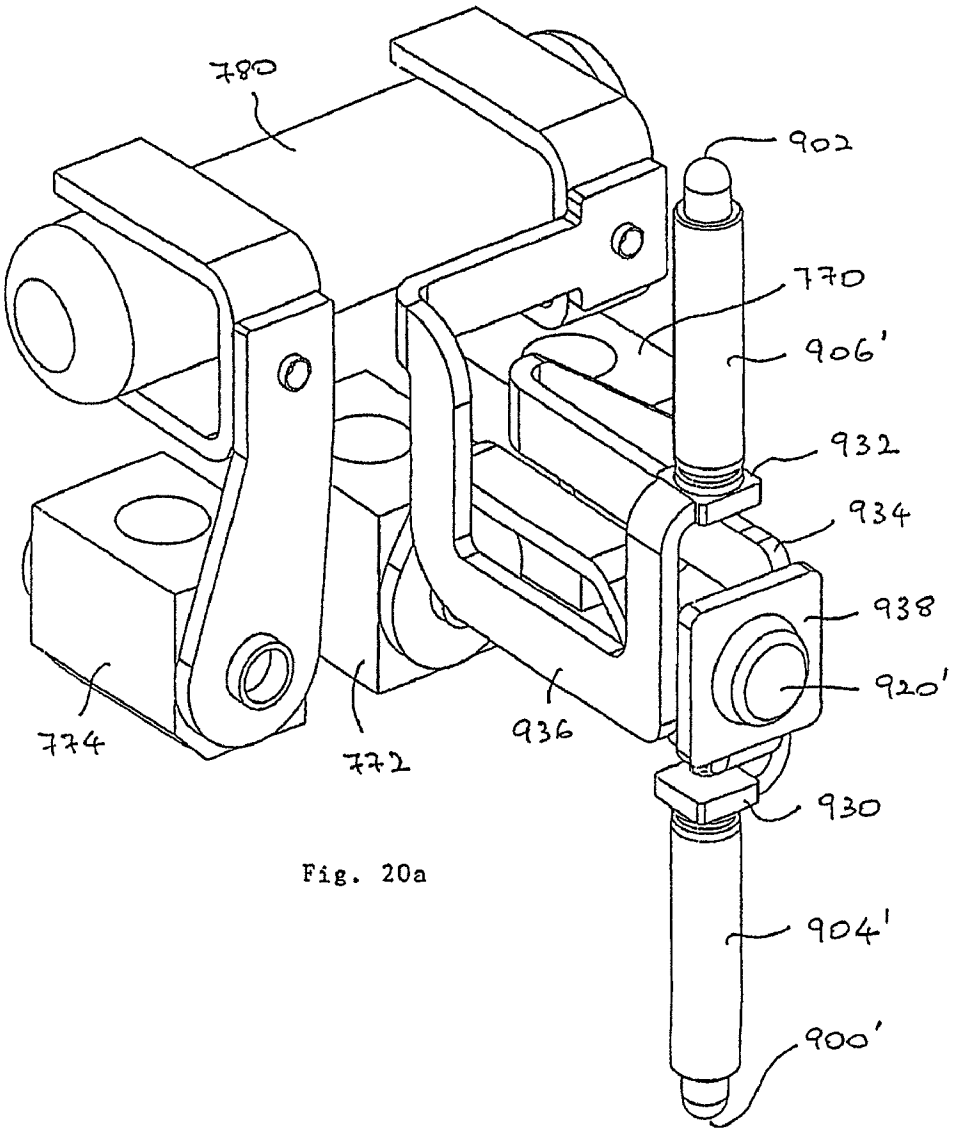
FIGS. 20*a* and 20*b* shows different perspective views of an internal structure of the electrical plug of FIG. 20.
Figure 20B:
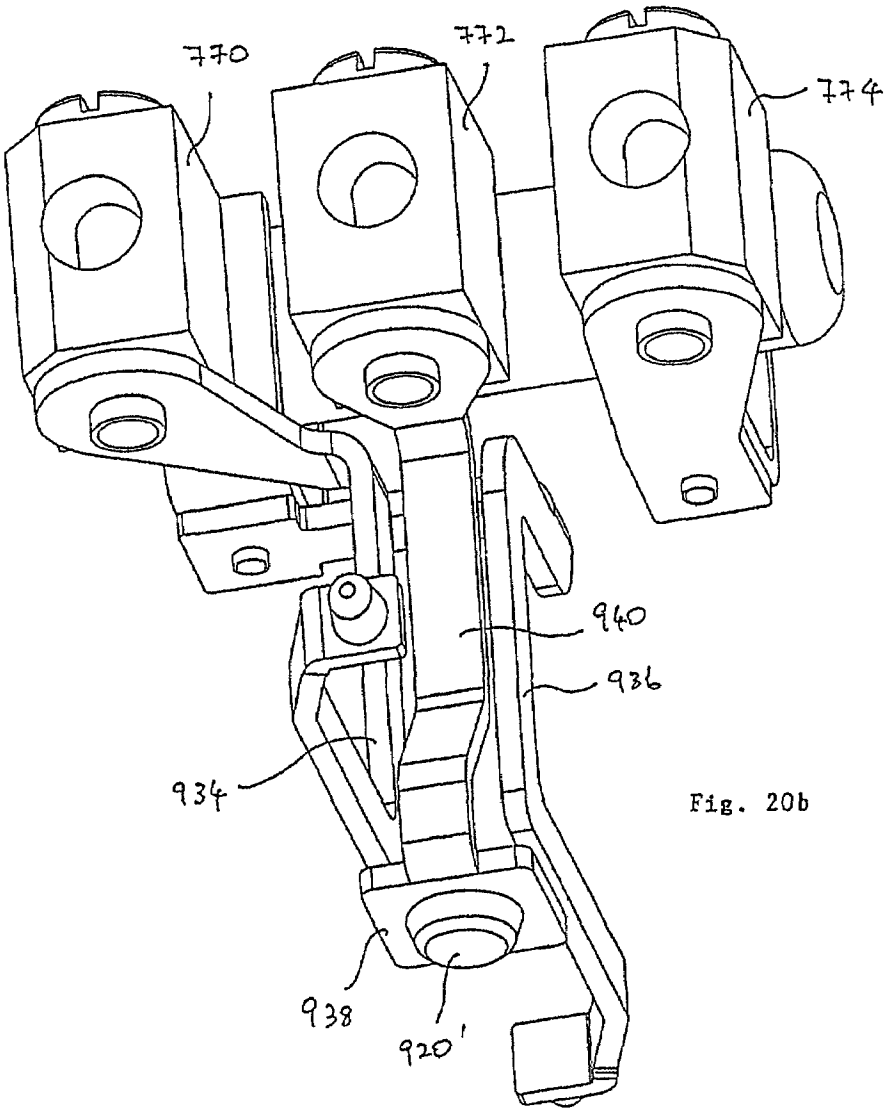

The plug 750 includes a cover 752 and a ringed base 754 forming a housing. The cover 752 is attached to the base 754 via screws 756 through threaded holes 758 so that the cover 752 can be separated from the base 754 with ease. A cable 760 carrying three electrical wires 762, 764, 766 for "Earth", "Neutral" and "Live" polarities of a power supply has one end connected to an electrical device and the other end connected to the plug 750. Two elastomeric members 768 are disposed in the plug 750 near the entry of the cable 760 to resiliently hold the cable 760. The three wires 762, 764, 766, which are typically insulated, are stripped to expose a length of copper and attached to respective conductive terminals 770, 772, 774 using terminal screws 770*a*, 772*a*, 774*a*. The terminals 770, 772, 774 are made of metal so that each wire 762, 764, 766 is electrically connected to each terminal 770, 772, 774 and are supported on a circular mounting member 776. The mounting member 776 rests in an opening of the ringed base 754 supported from a lug 778 formed at an edge of the mounting member 776. A fuse 780 is provided to prevent over-supply of current which may damage an electrical device connected to the plug 750. The mounting member 776 also has an insulative partition 782 formed on the base 754 to reduce the possibility of any short-circuit between the terminals 770, 772, 774 from occurring. Protruding from the other side of the mounting member 776 is a contact arm 784 which has a similar structure as the contact arm 441 of the power point connector 400' of FIG. 11*a*/11*b*. FIG. 20*a* shows a perspective view of the cylindrical holders 904', 906' connected to the terminals 770, 772, 774 (with the rest of the components of the plug 750 not shown). The contact arm 784 will not be further elaborated here, but how the protruding heads 900', 902' and surface 920' are electrically connected to the respective terminals 770, 772, 774 will now be described. Each holder 904', 906' stands on a support element 930, 932 which is connected via a series of angular elements 934, 936 to respective "neutral" and "live" terminals 770, 774. The structure of the angular elements 934, 936 is shown in a different perspective in FIG. 20*b*, with the holders 904', 906' omitted. In this embodiment, the angular element 936 is connected to the "live" terminal 774 via the fuse 780 which provides short-circuit protection. The engagement surface 920' is also provided on a support element 938 and is connected to the earth terminal 772 via an angular element 940 (see FIG. 20*b*). When assembled, the holders 904', 906' are housed in the contact arm 784 with each head 900', 902' and the surface 920' protruding out of the contact arm, similar to that shown in FIG. 11*c*.

Coming back to FIG. 20, the base 754 has a semi-circular channel 786, 788 formed on each side of the terminals 770, 772, 774 for attaching a flange member 790 similar to that used for the power point connector 400 described earlier. The flange member 790 includes snap fit connectors 792 to clip onto the semi-circular channels 786, 788 so that the flange member 790 is movable relative to the base 754. The flange member 790 has a circular opening 794 to allow the contact arm 784 to protrude through when the mounting member 776 sits on the ringed base 754. Similar to the connector 400', both ends of the contact arm 784 are covered by inwardly extending protection members 796, 798. This arrangement is conceptually similar to that of the connector 400 of FIG. 9*a*/9*b* and the contact arm 784 is also rotatable with respect to the protection members 796, 798 as shown in FIGS. 21 and 22.

Figure 21:
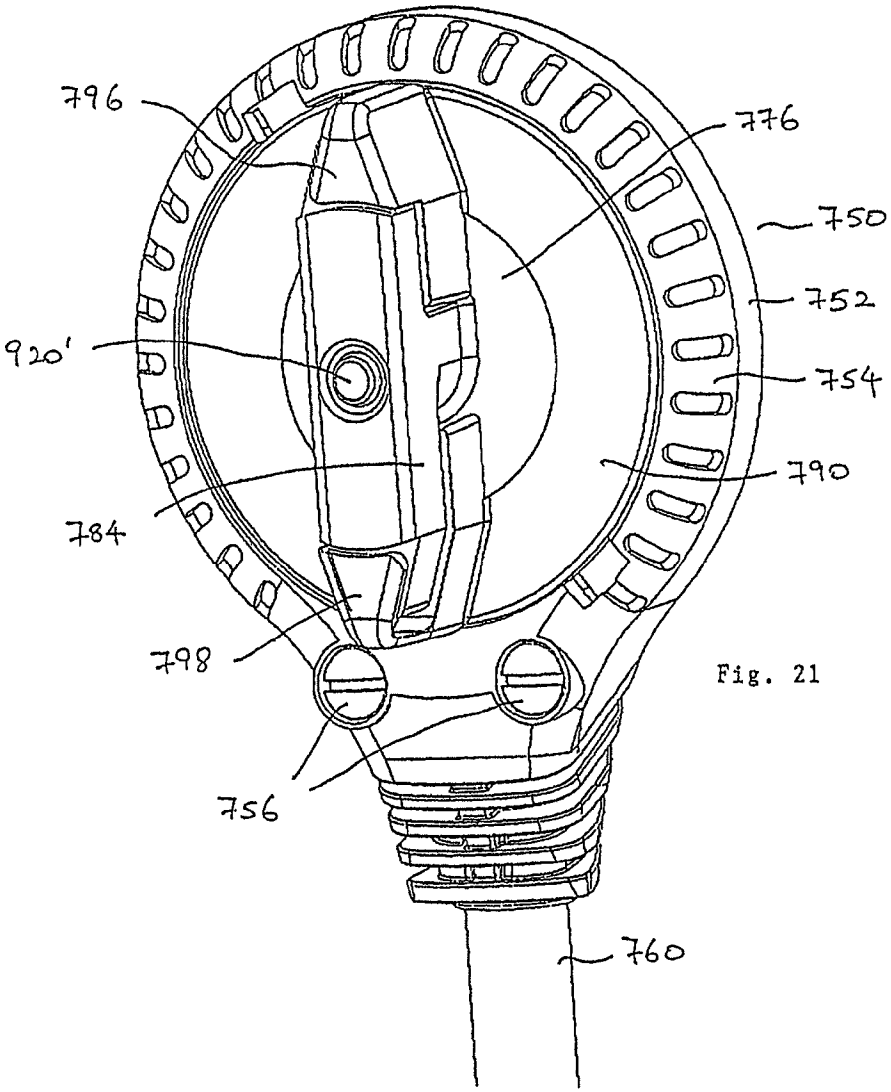
FIG. 21 shows a bottom perspective view of the electrical plug of FIG. 20 illustrating a contact arm with ends covered by two protection members.
Figure 22:
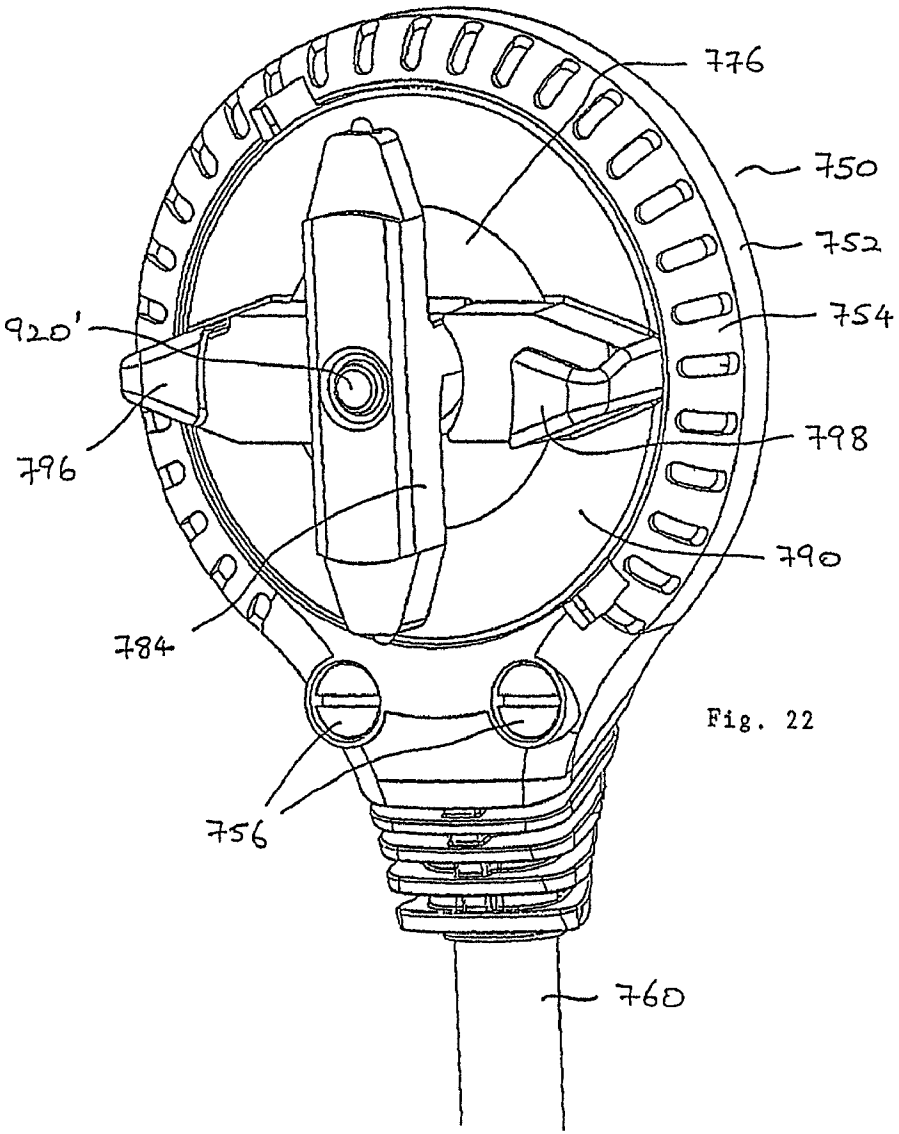
FIG. 22 shows the same view of FIG. 21 with the contact arm rotated.

Using the first embodiment of the track section, as an example, in use, the plug 750 is inserted into the slot 110 (see FIGS. 1 and 3) at a desired point with the contact arm 784 aligned with the protection members 796, 798 as shown in FIG. 21. As the plug 750 is inserted into the slot 110, the engagement surface 920' engages the central portion 162 of the earth spring 160 depressing the spring 160 towards the base 120. The limit being reached when the flat portion 162 of the spring 160 touches the projection 152 of the base 120. The plug 750 is then rotated 90 degrees so that the contact arm 784 is at right angles to the protection members 796, 798 which are prevented from rotating by the projecting edges 176, 178. At the position shown in FIG. 22, the contacts 900', 902' presses against the two conductors 126, 128 and an electrical connection is formed between the respective wires 762, 766 for providing "live" and "neutral" polarities and the two conductors 126, 128.

Using the plug 750 as proposed allows a user to connect his electrical device or appliance anywhere along the track section 100 and access electrical power by a simple "insert and twist" action, similar to the power point connector 400.

Figure 12:
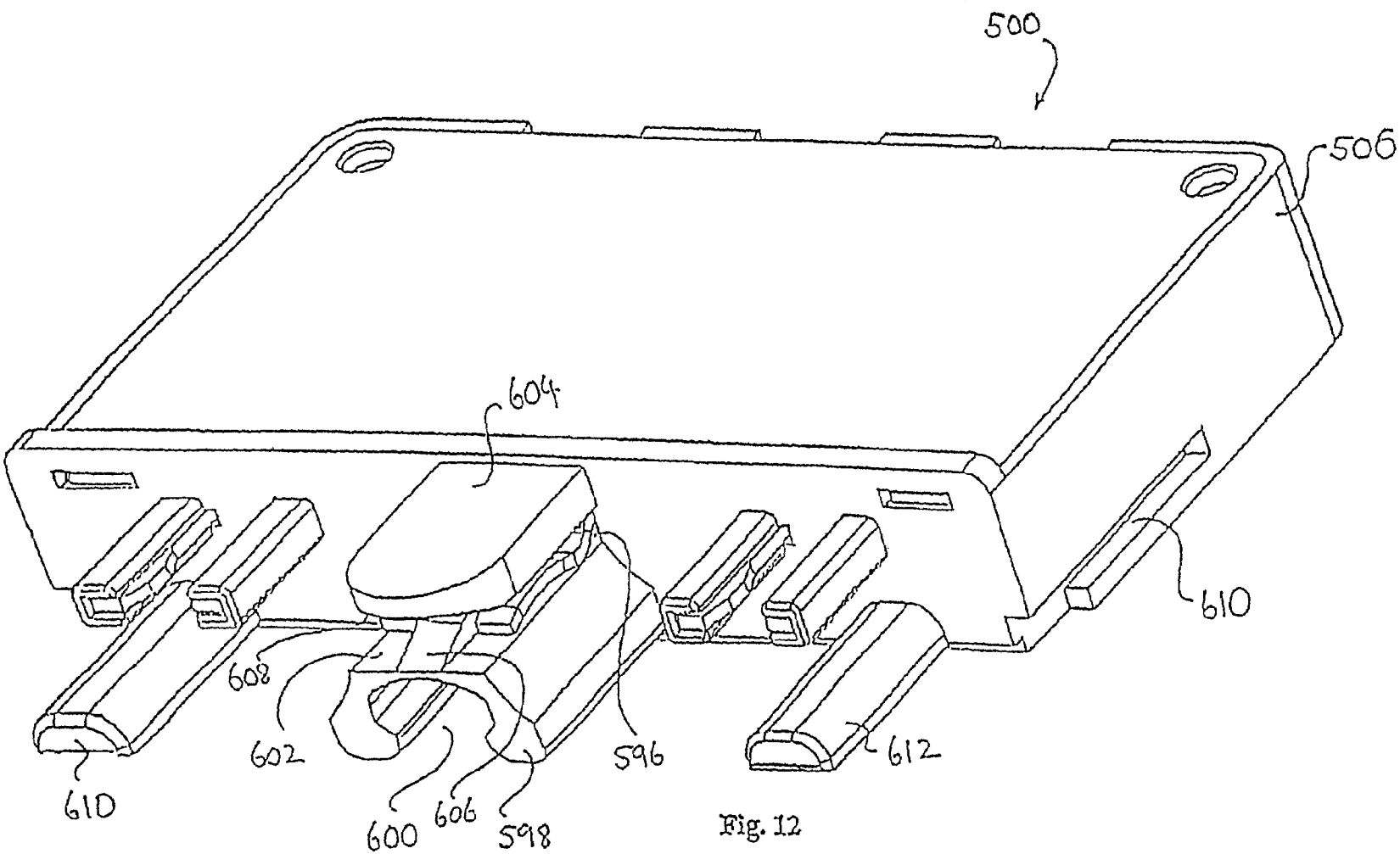
FIG. 12 is a perspective view of a terminal connector unit which is arranged to connect the track sections to an electricity supply.
Figure 13:
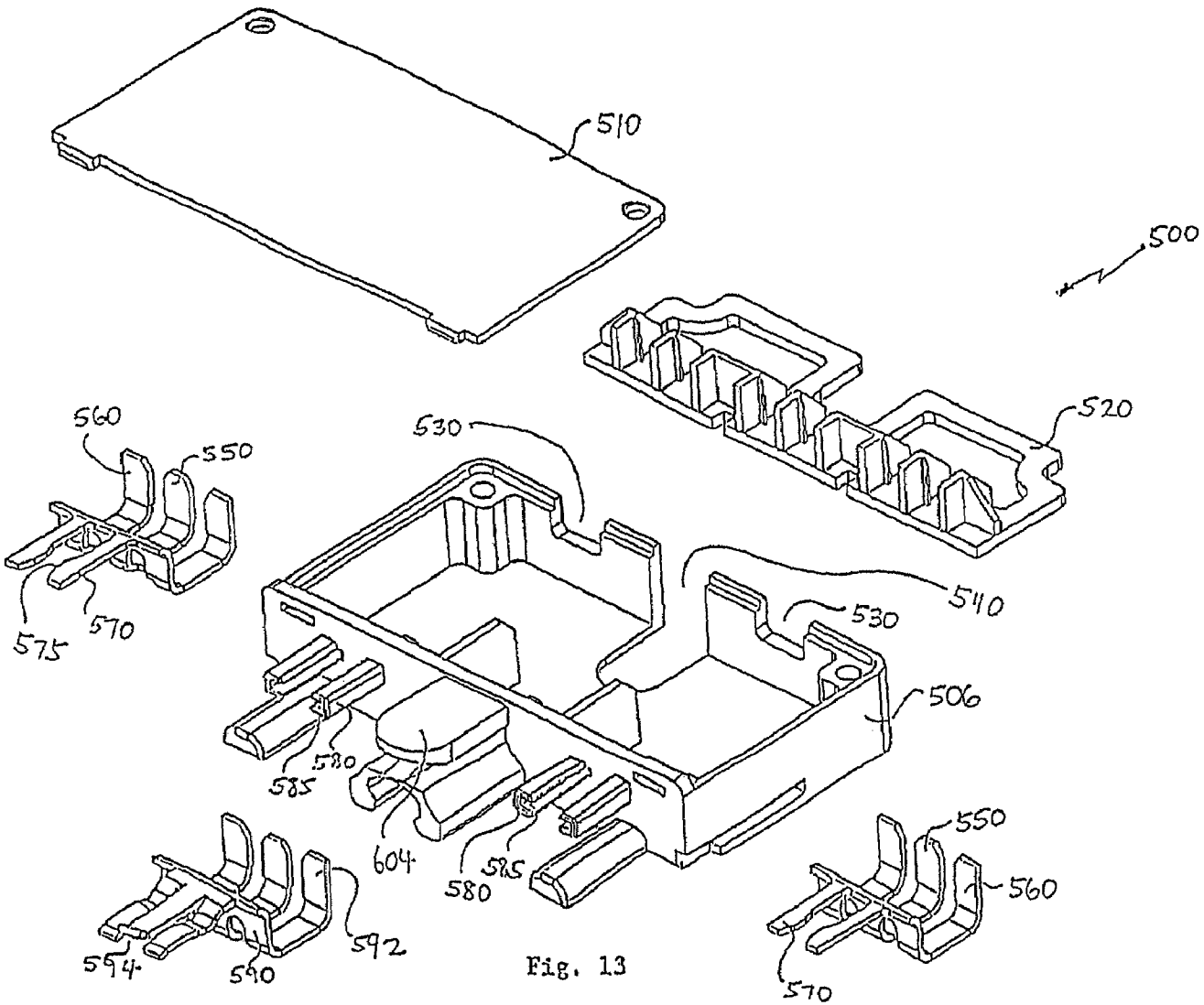
FIG. 13 is an exploded perspective view of the unit of FIG. 12.

A power supply/connection unit 500 housed within joints 200-260 and then connectors 280, 300 is illustrated in FIGS. 12 and 13. The unit 500 comprises a housing 506 having a cover 510. The housing 506 is provided with openings 530 through which run respective cables which connect respective live and neutral contacts of adjacent units 500, as is described below, and a larger opening 540 for receiving a mains cable to supply power to the unit. Cable catches 520 hold the mains cable and constituent cables in place in the housing 500. Live and neutral connectors 550 are each provided with three terminals 560 for cable connection and two projecting contacts 570 having a bulbous end 575 which are arranged to engage both sides of the electrical conductors 126, 128 of the track section 100. The housing 500 is provided with projections 580 each having a slot 585 which continues through to the inside of housing 500 so that the contacts 570 may be inserted through the wall of housing 500 with the terminals 560 lying inside the housing 500 and the contacts 570 lying in slots 585 with the bulbous ends 575 projecting from the slots. Earth connector 590 has similar terminals 592 and a three arm earth contact 594. Of the three arms, the outer two arms have the same undulating form with the middle arm being of straight form the combination being such that earth spring engagement surfaces of the arms slightly overlap to hold the earth spring tightly between them. An opening 596 is provided in housing 500 through which the contacts 595 project. Below the contacts is provided a first lug 598 having an opening 600 which slots around projection 152 of the track section 100. The contact 594 rests on a surface 602 of the lug 598. A further lug 604 projects above the lug 598 and engages the cavity 150. The opposed surfaces of lug 598 and projection 604 have bevelled or slanted surfaces 606, 608 to guide the earth spring 160 into engagement with the earth contact 594. Further lugs 610, 612 are provided to engage in cavities 180, 182 of the track section to provide further support.

A slot 610 is provided on each side of the housing 500 the use of which will now be described with reference to FIG. 14 which illustrates a housing of the end connector 280. The housing comprises a base 620 and a cover 624 closed at one end to form a neat end closure. The base 620 includes a mains cable opening 626 and two resiliently displaceable catch members 628. A tray for receiving the unit 500 is formed by the base 620 and raised perimeter sides 630, 632, 634. Two raised lugs 636 are mounted on walls 630, 634 and overhand walls 630, 634, projecting into the tray 629. Mounting openings 640 are provided in the base 200 on either side of the tray 629.

In use, a terminal unit 500 is mounted on a base 620 by placing the unit 500 in the tray 629 and sliding this forward so that slots 610 engage lugs 636 and until the unit 500 passes over displaceable catch member 628 which spring up to lock the unit 500 in place against wall 632.

Figure 15:
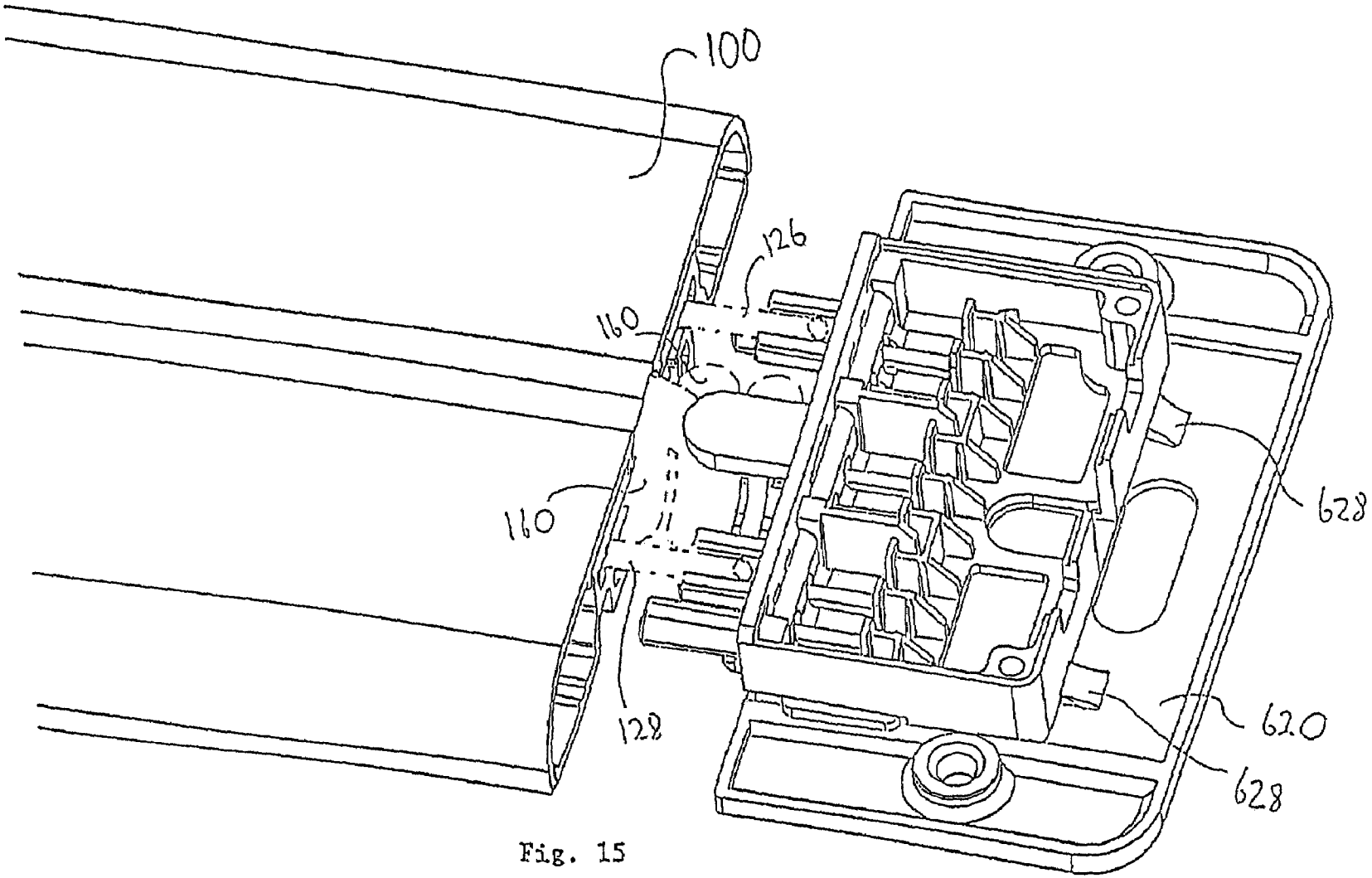
FIG. 15 shows the terminal connector unit engaged with the track section.

The unit 500 and base 620 are then engaged with the track section 100 as shown in FIG. 15 in a sliding fit. In FIG. 15, the conductors 126, 128 and earth spring 160 base been artificially extrapolated beyond the end of the track section 100 (these components would not normally protrude) and shown in phantoms lines to illustrate the manner of engagement.

Figure 14:
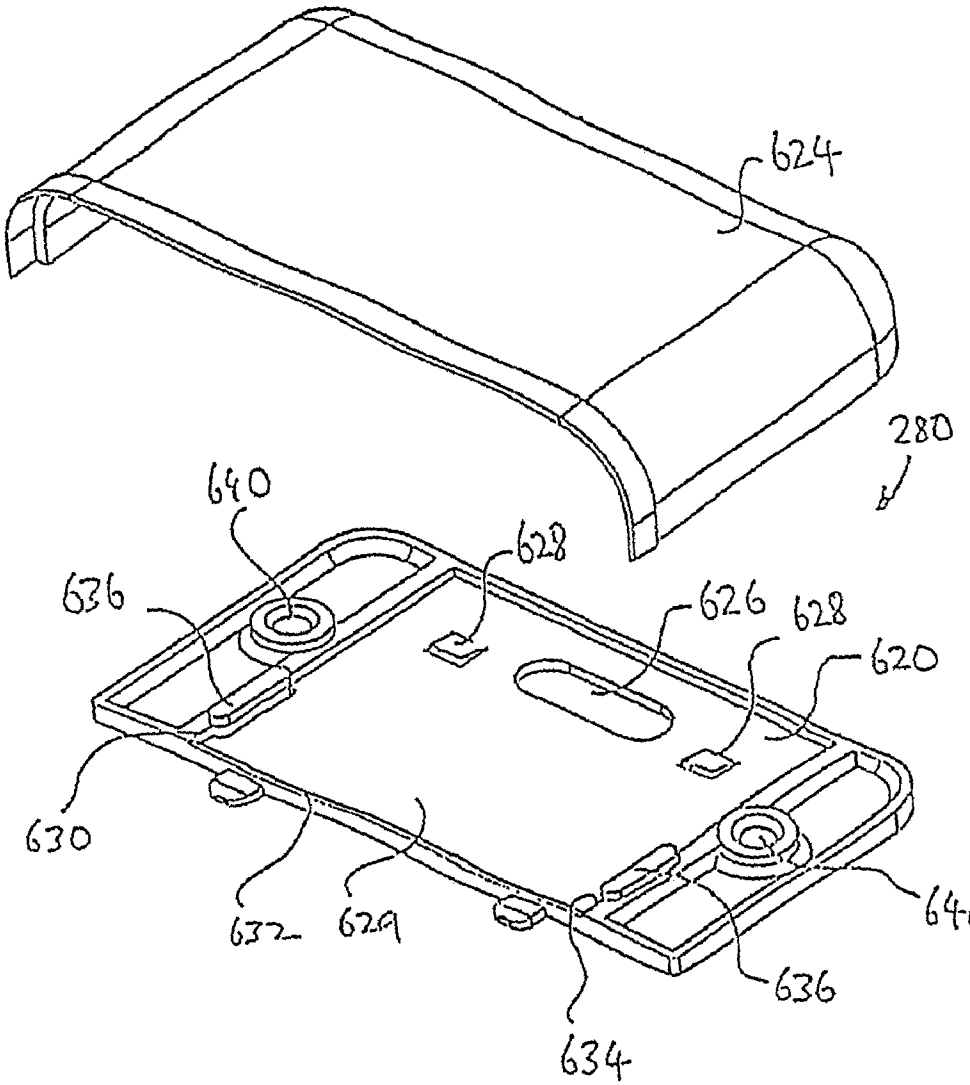
FIG. 14 illustrates a casing for the terminal connector unit.
Figure 16:
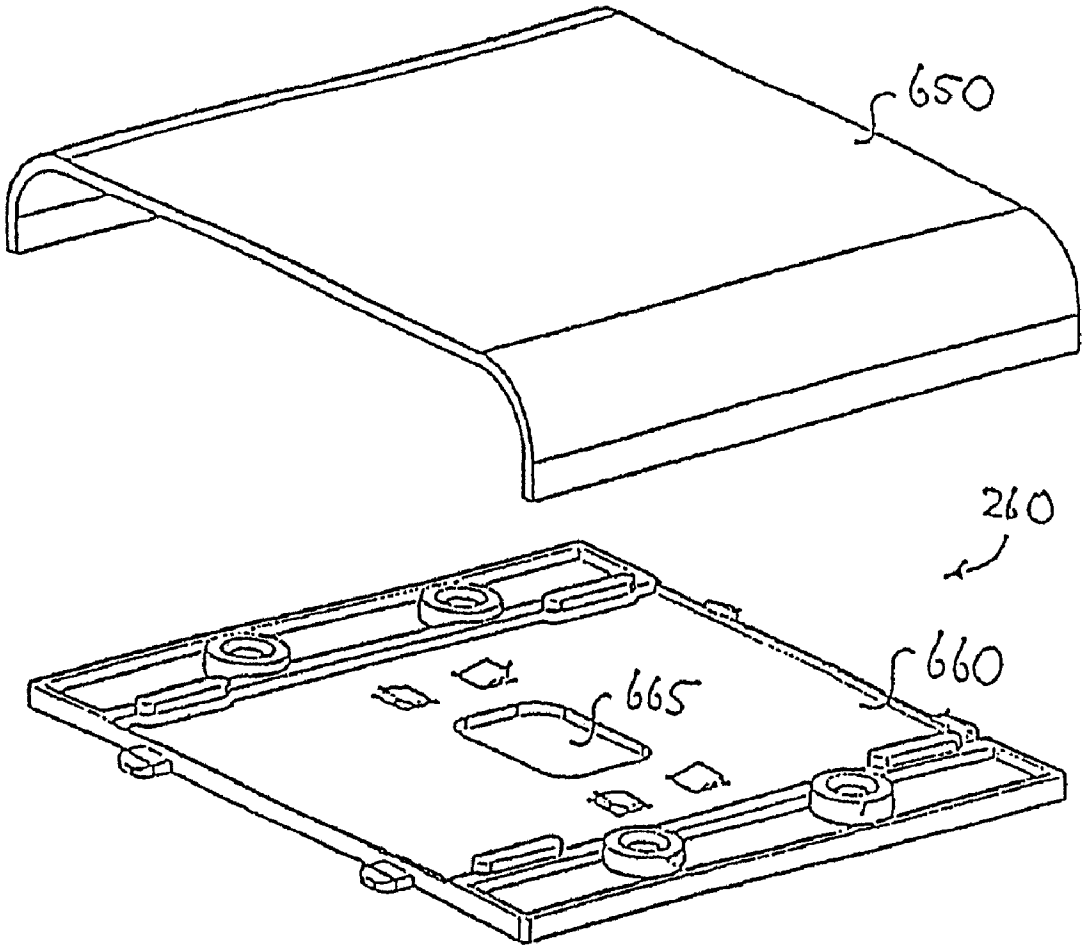
FIG. 16 illustrates a 180 degree joint used between track sections.
Figure 17:
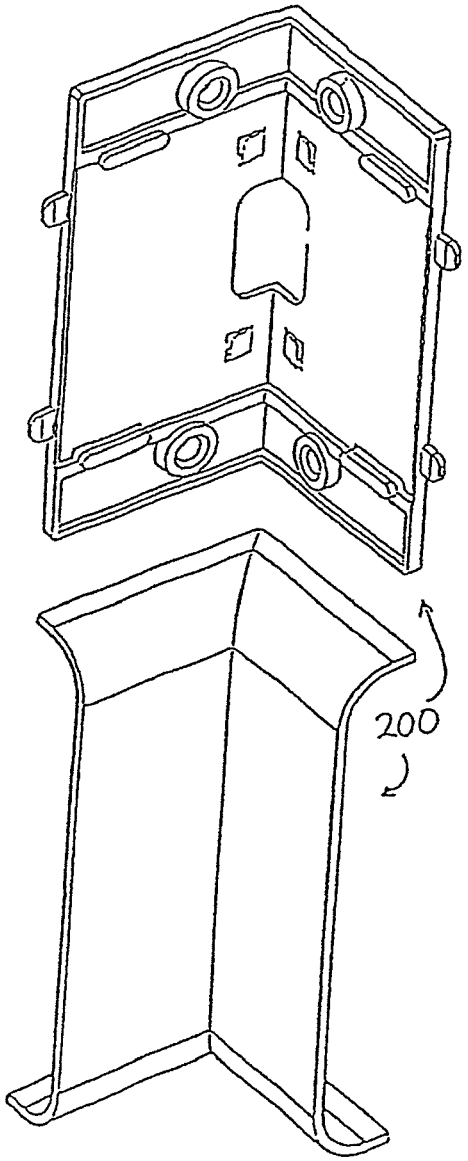
FIG. 17 shows a 90 degree joint.
Figure 18:
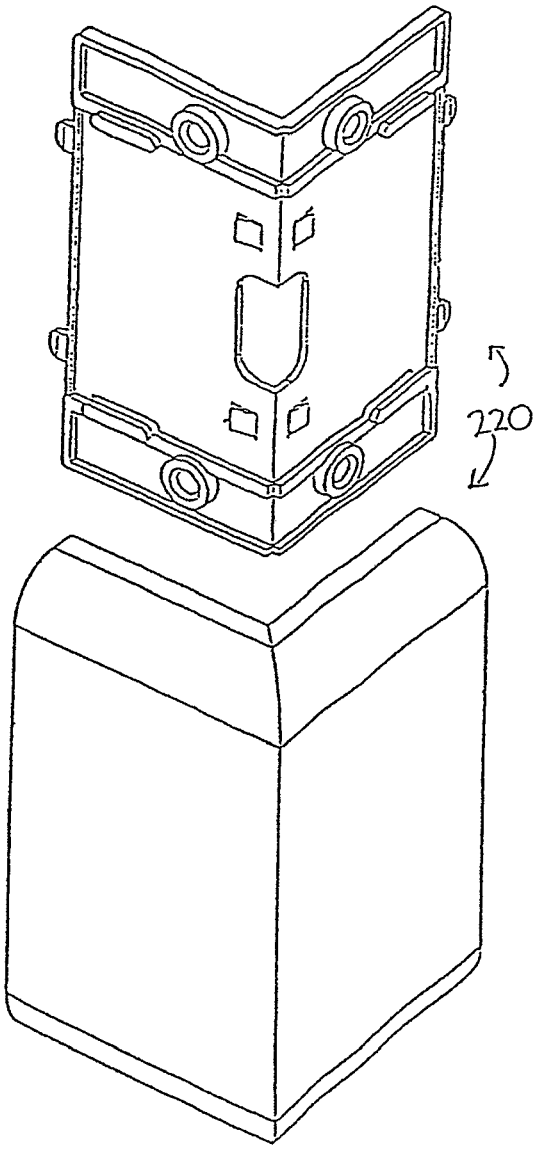
FIG. 18 shows a 270 degree joint.

The housing of a 180 degree joint 260 is shown in more detail in FIG. 16 and comprises a cover 650 and base 660 which is a similar construction to base 620 of the end connector 280 of FIG. 14 except that the base 660 has the elements of the base 620 as well as a mirror image so that two terminal units 500 may be connected back to back. A larger central opening 665 for receiving mains cabling is provided so that each terminal 500 can feed the track section to which it is connected separately. Alternatively, the terminal units 500 may be connected one to each other through openings 530 to provide electrical continuity. A 90 degree housing for a 90 degree joint 200 and for a 270 degree joint 220 are shown in FIGS. 17 and 18. These are similar to the joint 260 except for the relative angles of the trays for receiving the units 500 and will not be described further.

Figure 19:
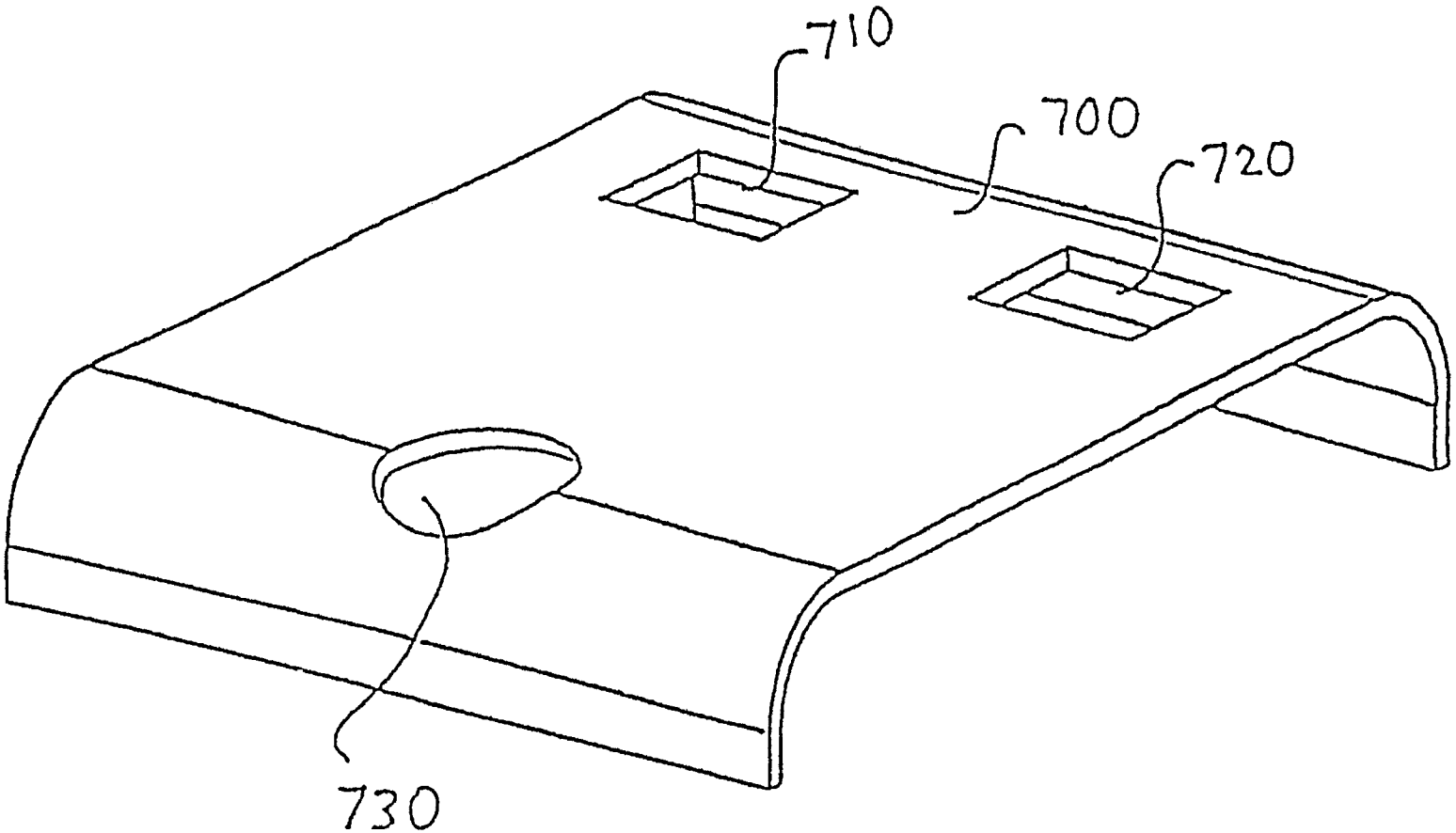
FIG. 19 shows a communications socket cover.
Figure 19A:
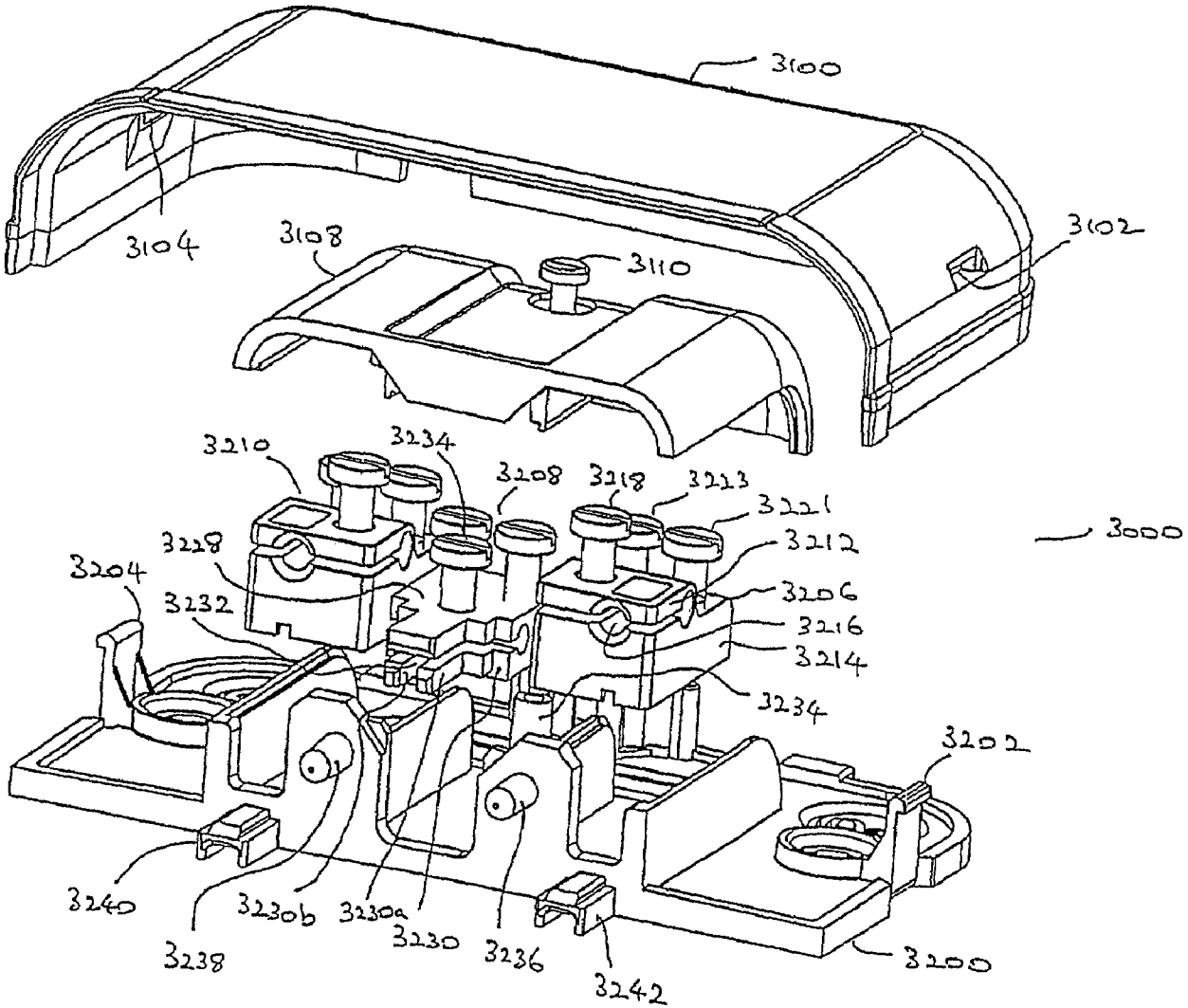
FIGS. 19*a* and 19*b* show different perspective views of a variation of a power supply/connection unit.
Figure 19B:
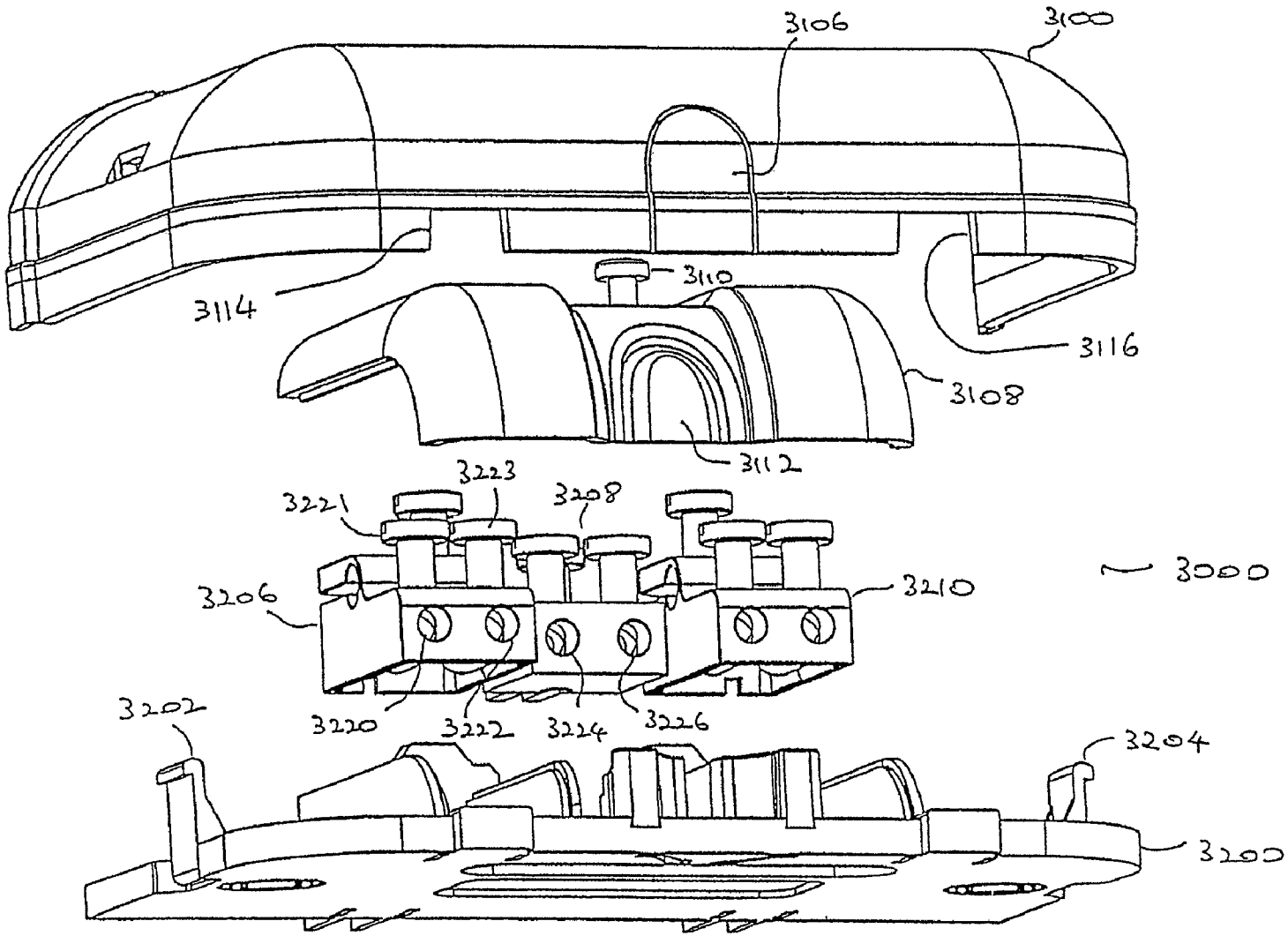

FIGS. 19*a* and 19*b* show respectively front and rear perspective exploded views of a further embodiment of the power supply/connection unit 3000. The unit 3000 comprises a housing having a top cover 3100 and a base 3200. The base 3200 has a snap-fit catch 3202, 3204 at two ends for engaging a corresponding aperture 3102, 3104 formed in the top cover 3100. Instead of using a connector 550, 590 with terminals 560, 592 to pierce into the mains cable, a connecting device 3206, 3208, 3210 is provided which is made of conductive material. The "live" and "neutral" connecting devices 3206, 3210 for connecting the respective conductors 2126, 2128 (see FIG. 7*a*) has the same structure as shown in FIG. 19*a* and only one will be described.

Figure 23:
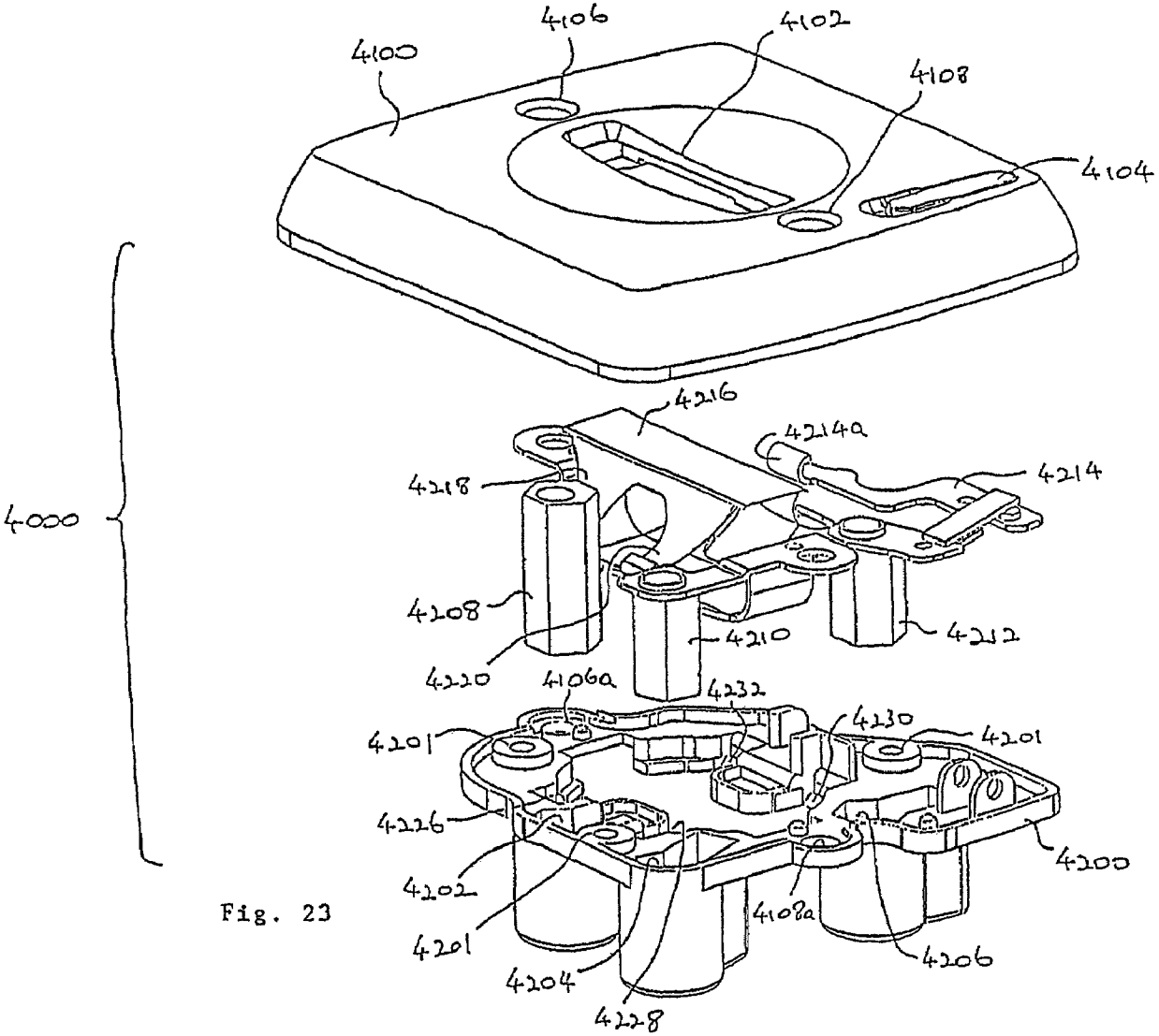
FIG. 23 shows an exploded perspective view of an electrical socket which can be used to receive the power point connector of FIG. 8 or the electrical plug of FIG. 20.
Figure 23A:
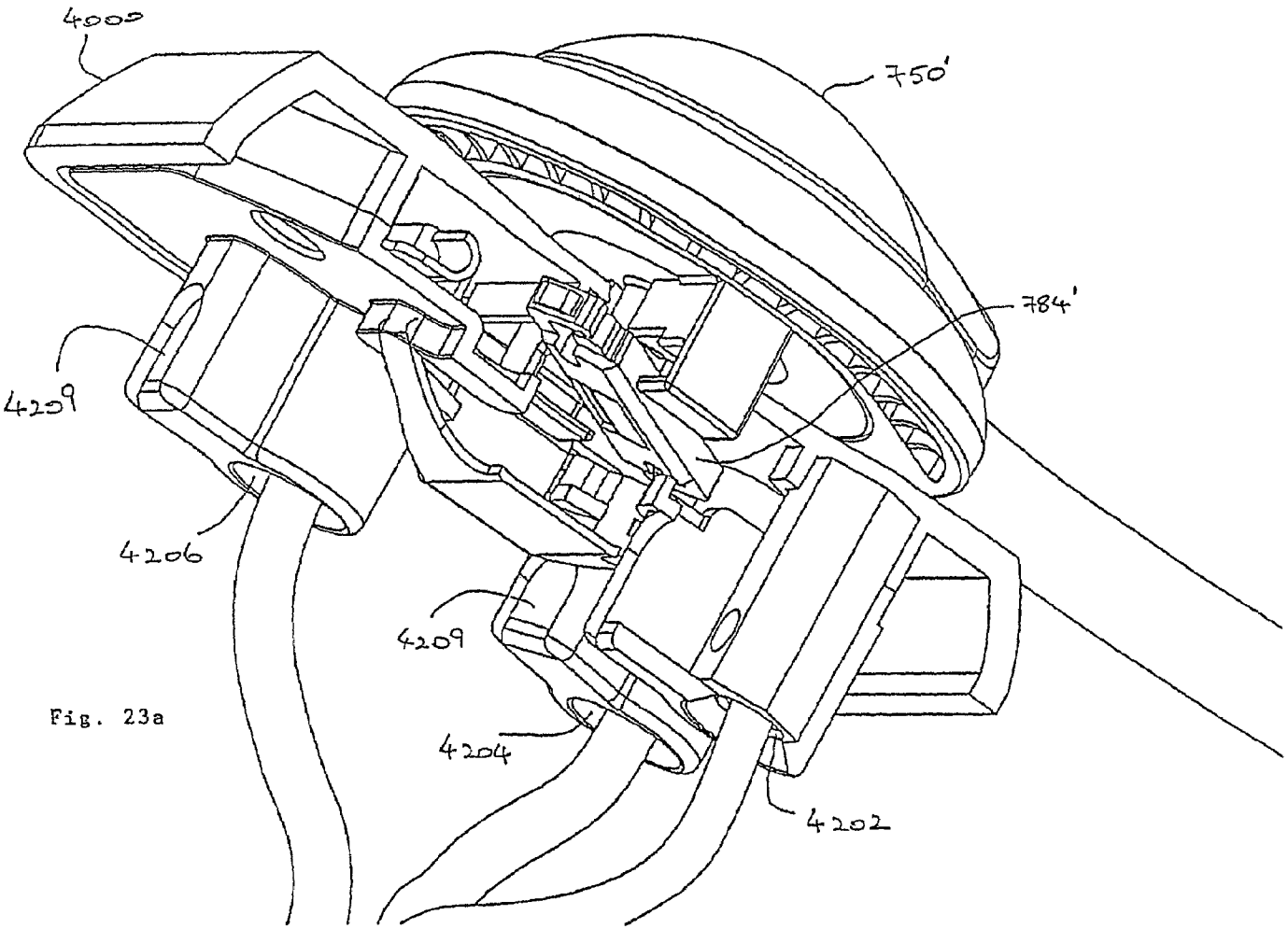
FIG. 23*a* shows a rear perspective view of the electrical socket of FIG. 23 being arranged to receive a variation of an electrical plug of FIG. 20 and which is attached to three electrical wires.

The connecting device 3206 has an upper and a lower portion 3212, 3214 with opposing grooves in each portion which forms a main channel 3216 as shown in FIG. 23*a*. The main channel 3216 is arranged to receive a conductor 2126 and the upper portion 3212 is then secured to the lower portion 3214 by a screw 3218 which fastens the conductor 2126 in the main channel 3216. As shown in FIG. 19*b*, the connecting device 3206 further includes two auxiliary channels 3220, 3222 formed in the lower portion 3214 with a first channel 3220 arranged to receive a mains wire and in this embodiment the electrical wire carrying "live" or "neutral" polarity of the power supply. The second auxiliary channel 3222 is available for "looping" purpose when, for example, the track section needs to be extended, two of such connection units 3000 can be used and placed in back-to-back relationship with each other so that an electrical wire can connect both of the second auxiliary channels 3222 together. Thus, electrical power can be extended to the newly added track section.

To connect an electrical wire to one of the auxiliary channels 3220, 3222, the insulation of the electrical wire is first removed to expose a length of copper which is then electrically attached to one of the auxiliary channels using a screw 3221, 3223.

FIG. 19*b* shows the cover 3100 having a "snap-off" section 3106 which can be removed to create an opening to allow electrical wires through when the cover 3100 is fixed onto the base 3200.

The "earth" connecting device 3208 for the earth connection also has two channels 3224, 3226 formed in the rear, one for connecting to "earth" of a mains power supply and the second for looping purpose similar to the connecting devices 3206, 3210 carrying the "live" and "neutral" polarities.

Instead of engaging the earth spring (as described earlier), an alternative is for the earth connecting device 3208 to be coupled to the base 2180 which in the second and third embodiments of the track section 100 is also a conductor. As an example, the earth connecting device 3208 is adapted to electrically connect to the projection 2152 of FIG. 7*a* which forms part of the base and since the base 2180 is conductive, the earth spring 2160 would also be electrically connected to the earth connecting device 3208 as will now be described.

To connect to the projection 2152, the front of the earth connecting device 3208 comprises resiliently displaceable upper and lower portions 3228, 3230. The lower portion 3230 is further divided into two opposing arms 3230*a*, 3230*b* and together with the upper portion 3228 forms a T-shaped cavity 3232 for engaging the T-shaped projection 2152 with the two opposing arms 3230*a*, 3230*b* engaging both sides of the leg 2152*a* of the projection 2152. A screw 3234 is then used to close the upper and lower portions 3228, 3230 to couple the projection 2152 within the cavity 3232.

Preferably, an inspection cover 3108 covers the three connecting devices 3206, 3208, 3210 and is preferably made of transparent plastic. The inspection cover 3108 is fixed to the base 3200 using a screw 3110 threaded through a screw holder 3234 formed in the base 3200. As shown in FIG. 19*b*, the inspection cover similarly comprises a "snap-off" section 3112 to allow wires through similar to that for the top cover 3100.

The terminal connector 3000 also has four guide members 3236, 3238, 3240, 3242 which extends from a surface and is arranged to engage slidably with a track section 100. The upper guide members 3236, 3238 have a cylindrical tapered body and are positioned to slide into respective cavities 2182, 2184 (see FIG. 7*a*) so that each guide member 3236, 3238 sits on the surface 2156*a*, 2158*a* of the corresponding projection 2156, 2158. The lower guide members 3240, 3242 are generally rectangular and are arranged to be inserted into cavities 2197, 2199 formed on the outer surface of the base 2180. In this way, the terminal connector 3000 is coupled to a track section 100 so that the different polarities of a mains power supply is distributed to the respective conductors and earth spring, or a further extension of the track section can be formed.

In other applications, it may not be possible or necessary to have a track section 100, such as on a support column or a pillar of a building or room. In this case, it may be preferred to have one or more wall electrical sockets to distribute electrical power via the plug 750 or the connector 400.

FIG. 23 shows an exploded view of such a socket 4000 which comprises a front cover 4100 and a back cover 4200, both preferably made of plastic. The front cover 4100 includes an opening in the form of an elongate slot 4102 through which a contact arm of the plug 750 or connector 400 is inserted. The cover 4100 also includes a switch 4104 which may further include a neon bulb which lights up when power is being supplied through the plug 750 or connector 400. The switch is of conventional design and will not be elaborated here. Screw holes 4106, 4106*a*, 4108, 4108*a* are provided, one on either side of the slot 4102 and correspondingly at two ends of the back cover 4200 so that a screw can be inserted through each pair of hole for fastening the socket 4000 to a wall or pillar. The back cover 4200 also includes three fastening holes 4201 which are used to fasten the back cover 4200 to the front cover 4100.

Figure 23B:
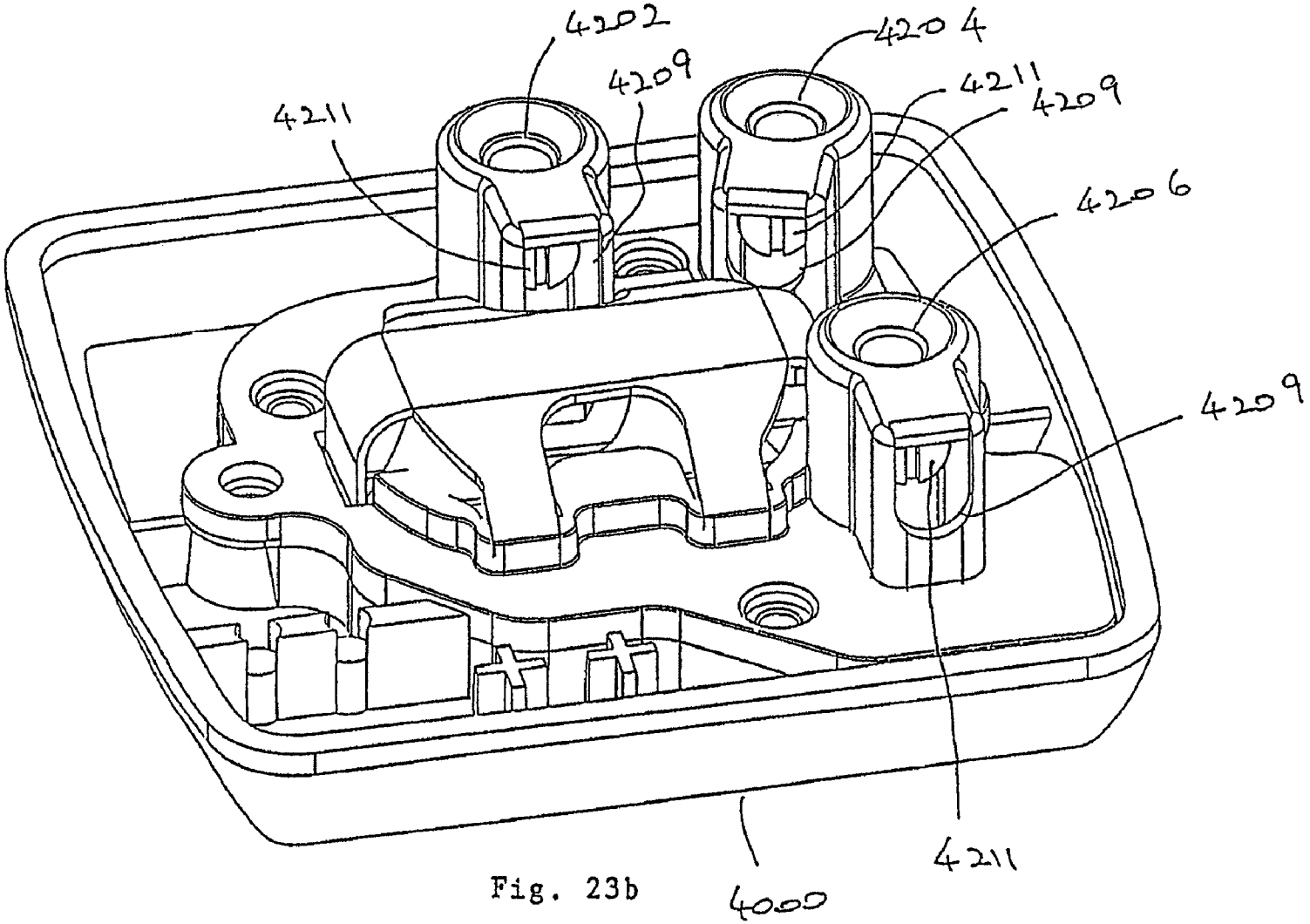
FIG. 23*b* shows a bottom view of the electrical socket of FIG. 23 illustrating three cavities for receiving the electrical wires of FIG. 23*a*.

The back cover 4200 includes three cavities 4202, 4204, 4206 for receiving respective polygonal shaped conductive terminals 4208, 4210, 4212. In this particular arrangement, the first terminal 4208 is wired to "neutral", the second terminal 4210 to "earth" and the third terminal 4212 to "live" of an electrical power source. The electrical wires carrying these polarities, with a length of exposed copper, are inserted through each cavity 4202, 4204, 4206 as shown in FIG. 23*a* which depicts a rear sectional view of the wall socket 4000 engaged with a variation of an electrical plug 750' described earlier but comprises a contact arm 784' with hook shaped ends (see also FIG. 24). Each terminal 4208, 4210, 4212 has a groove 4209 formed on one side of the terminal which allows a screw 4211 to be threaded through to make electrical contact with and to secure the exposed copper to the polygonal terminals 4208, 4210, 4212. This is shown more clearly in FIG. 23*b*, which depicts a rear perspective view of the wall socket 4000.

Coming back to FIG. 23, an angular element 4214 having an engagement surface 4214*a* extends from the third terminal 4212 to allow engagement by a contact arm of a plug 750 or connector 400. Nestled between the terminals 4208, 4210, 4212 lies a conductive member in the form of an earth spring 4216 which functions in a similar way as the earth spring 160 of FIGS. 5 and 6. The earth spring 4216 is typically made of flexible conductive material and is supported by four flexible arcuate legs 4218, 4220, 4222, 4224 (leg 4224 hidden from view) similar to the wings of the earth spring 160 of FIGS. 5 and 6. Each of these legs 4218, 4220, 4222, 4224 rests in respective holders 4226, 4228, 4230, 4232 formed on the back cover 4200.

Typically, the wall socket 4000 comes assembled ready for use. This means that the terminals 4208, 4210, 4212 are positioned in respective cavities and the back cover 4200 is fastened to the front cover 4100 using screws though holes 4201.

In use, the electrical mains wires are stripped to expose a length of copper which are inserted accordingly from the bottom and into each respective cavity 4202, 4204, 4206. Screws 4211 are then inserted through the grooves 4209 to make electrical contact with the exposed wires. The wall socket 4000 is then positioned as desired on a wall column or pillar and mounted using screws through holes 4106, 4106*a* and 4108, 4108*a*. The socket 4000 is now ready to receive a connector 400 or plug 750.

Figure 24:
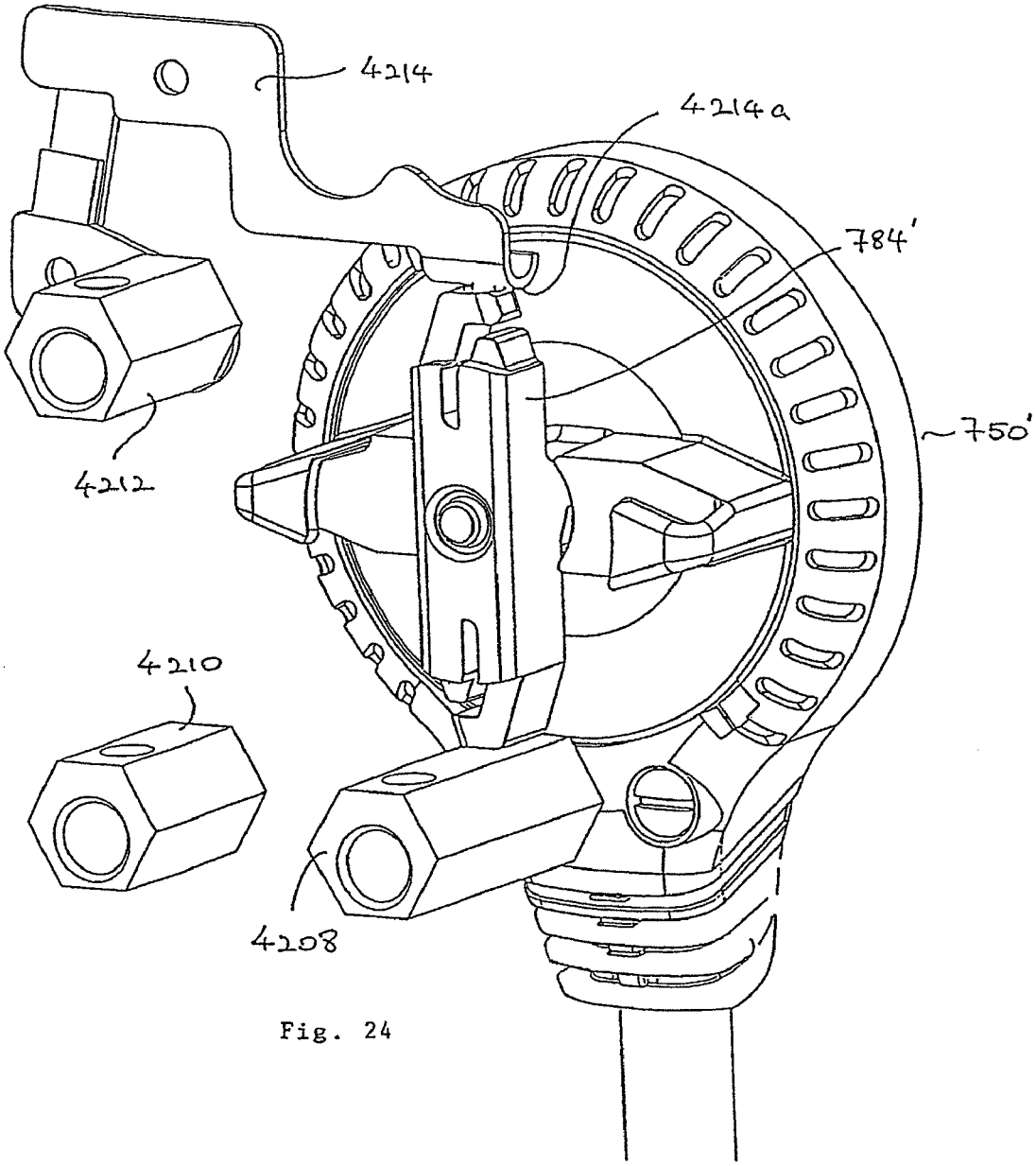
FIG. 24 shows a perspective view of the plug of FIG. 23*a* with the contact arm rotated to engage two conductive terminals of the electrical socket of FIG. 23.

FIG. 24 shows a perspective view of the plug 750' being engaged with two terminals 4208, 4212 of the socket 4000. As mentioned earlier, the plug 750' is a variation of that depicted in FIG. 21/22 and which comprises a contact arm 784' with hooked ends instead of resiliently displaceable contacts at each end. The contact arm 784' of this variation is similar to the first variation of power point connector 400 described earlier in FIG. 9*a*/9*b*. The contact arm 784' of the plug 750' is inserted through the slot 4102 (FIG. 23) and resiliently biases the earth spring 4216 towards the back cover 4200 which allows the contact arm 784' to be rotated through 90 degrees (by rotating the plug 750') so that respective hooked ends of the contact arm 784' are in an interference fit with the engagement surface 4214*a* of the angular element connected to the "live" terminal 4212 and a surface of the polygonal "neutral" terminal 4210. In this manner, power is being distributed through the socket 4000, through the plug 750' and then transmitted to an electrical device connected to the plug 750'.

As mentioned, the cable runs 146, 148 of track section 100 are adapted for data and/or communication cables. Such cables are fed through the cable runs 146, 148 and also through portions of the connector/joint housings on each side of the trays which receive the units 500. The cables may enter and exit the track through opening(s) 665. In order to allow user access to the data/communication cables, a 180 degree joint base as shown in FIG. 16 is used but with a different cover 700 as shown in FIG. 19, which is provided with openings 710, 720 for network connector or telecommunications cable sockets.

Figure 25:
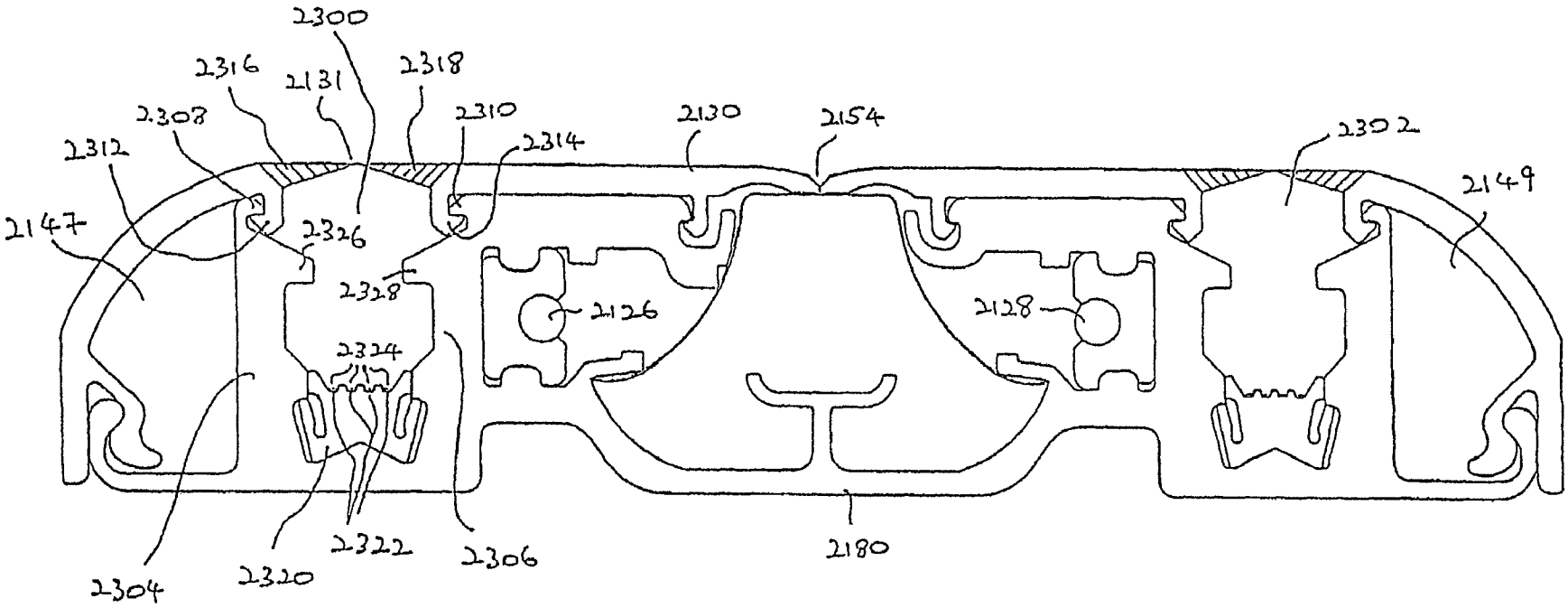
FIG. 25 shows a cross-sectional side view of the track section of FIG. 7*a* adapted to distribute communication signals.

In an alternative, the cable runs 146, 148 of track section 100 are in the form of further conduits 2147, 2149 adapted to hold further conductors which can be used to carry and distribute communication signals and the base 2180 and cavities 2182, 2184 similarly forms an EMI shield to shield these data conductors from the electrical conductors. This variation forms a fourth embodiment of the apparatus of the invention and is shown in FIG. 25 which will be described with referenced to the track section of FIG. 7*a*. However, it should be apparent that the track sections proposed by the first and second embodiments can similarly be modified to accommodate further conductors as will be described below.

FIG. 25 illustrates a cross-sectional view of the track section 100 of the third embodiment adapted to receive further conductors in two separate cavities 2300, 2302 formed in the conduits 2147, 2149. Since these two cavities 2300, 2303 are mirror images of each other, only one will be described.

Figure 26:
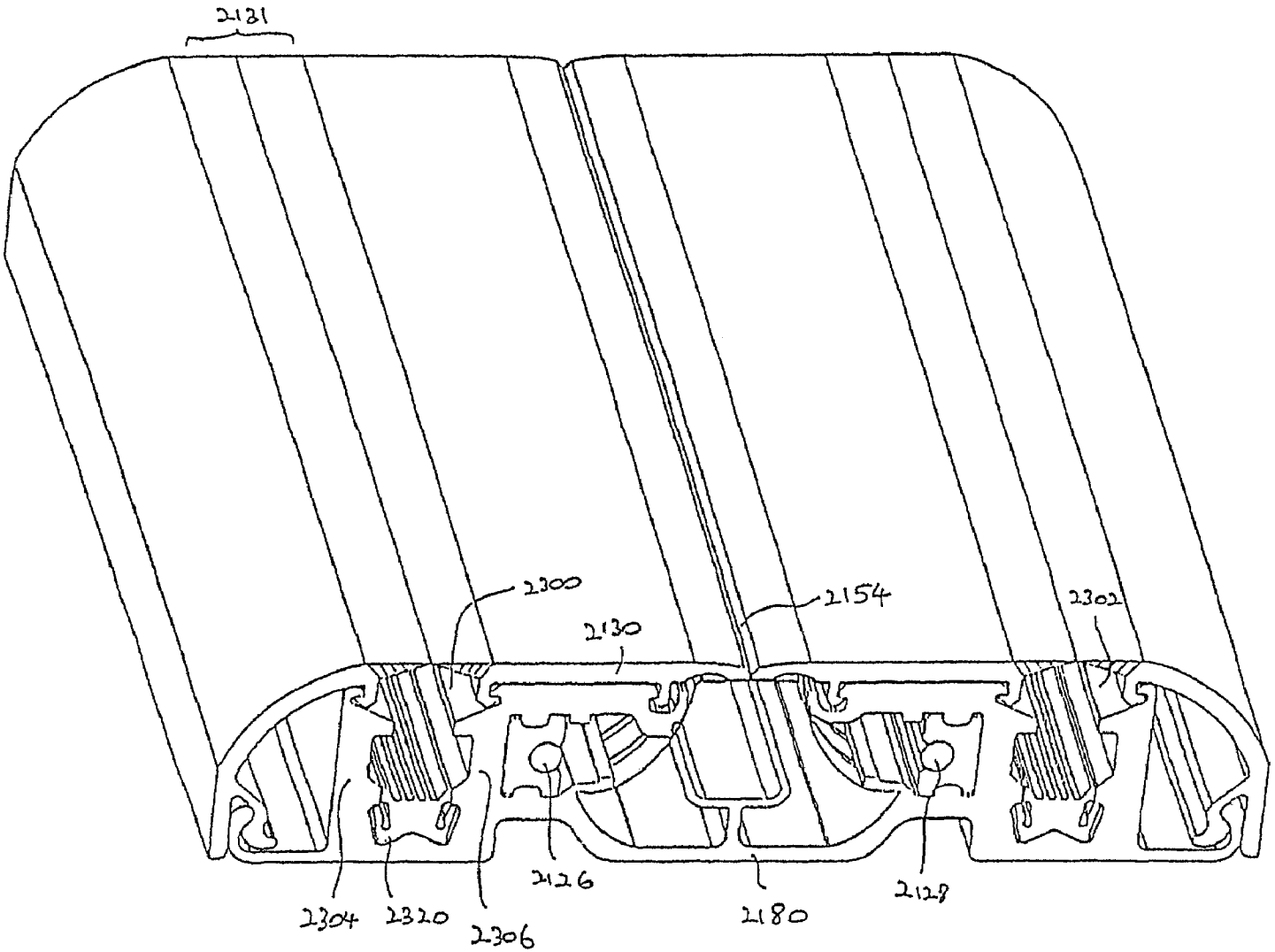
FIG. 26 shows a three dimensional view of the track section of FIG. 25.

The cavity 2300 is formed by projecting elements 2304, 2306 which includes hook formations 2308, 2310 for clipping to corresponding formations 2312, 2314 of the cover 2130. The cover 2130 has an opening in the form of an elongate slot 2131 which is similar to the slot 110 of the first embodiment and allows one or more data and/or communications connector (to be described below) to be connected at any point along the slot 2131 to transmit communication signals between the track section and the equipment connected to the other end of the connector. The slot 2131 is shown in FIG. 26 which depicts a perspective view of the track section 100 of the fourth embodiment.

The cover 2130 includes deformable flaps 2316, 2318 of a similar material as the flap 154 of the first embodiment, the flaps being used to cover the slot 2131 (and also the cavity 2300). In the cavity 2300 sits an elongate insulative tray 2320, preferably made of PVC, used to carry four identical conductors 2322 in spaced grooves 2324 which extends parallel to the conductors 2126, 2128 carrying electrical power. The tray 2320 serves to insulate the four conductors 2322 from the base 2180 since the conductors 2322 are used to carry communication signals, for example voice or data signals. The cavity 2300 is shaped to receive a data and/or communications connector which provides an interface for signals between a telecommunication or data device and the conductors 2322.

Figure 27:
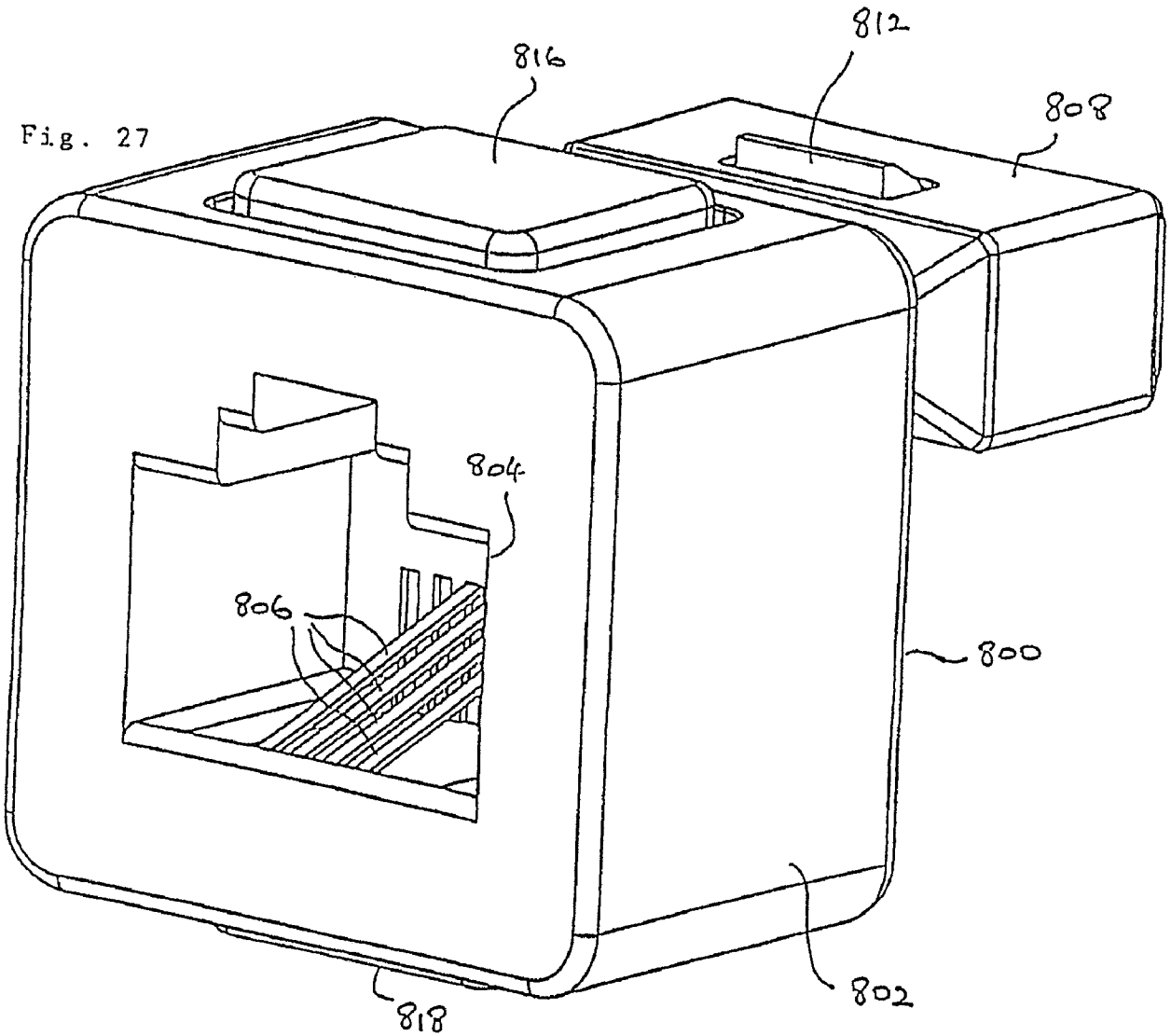
FIG. 27 shows a front perspective view of a data and/or communications connector for use with the track section of FIG. 25 for distributing communication signals.
Figure 28:
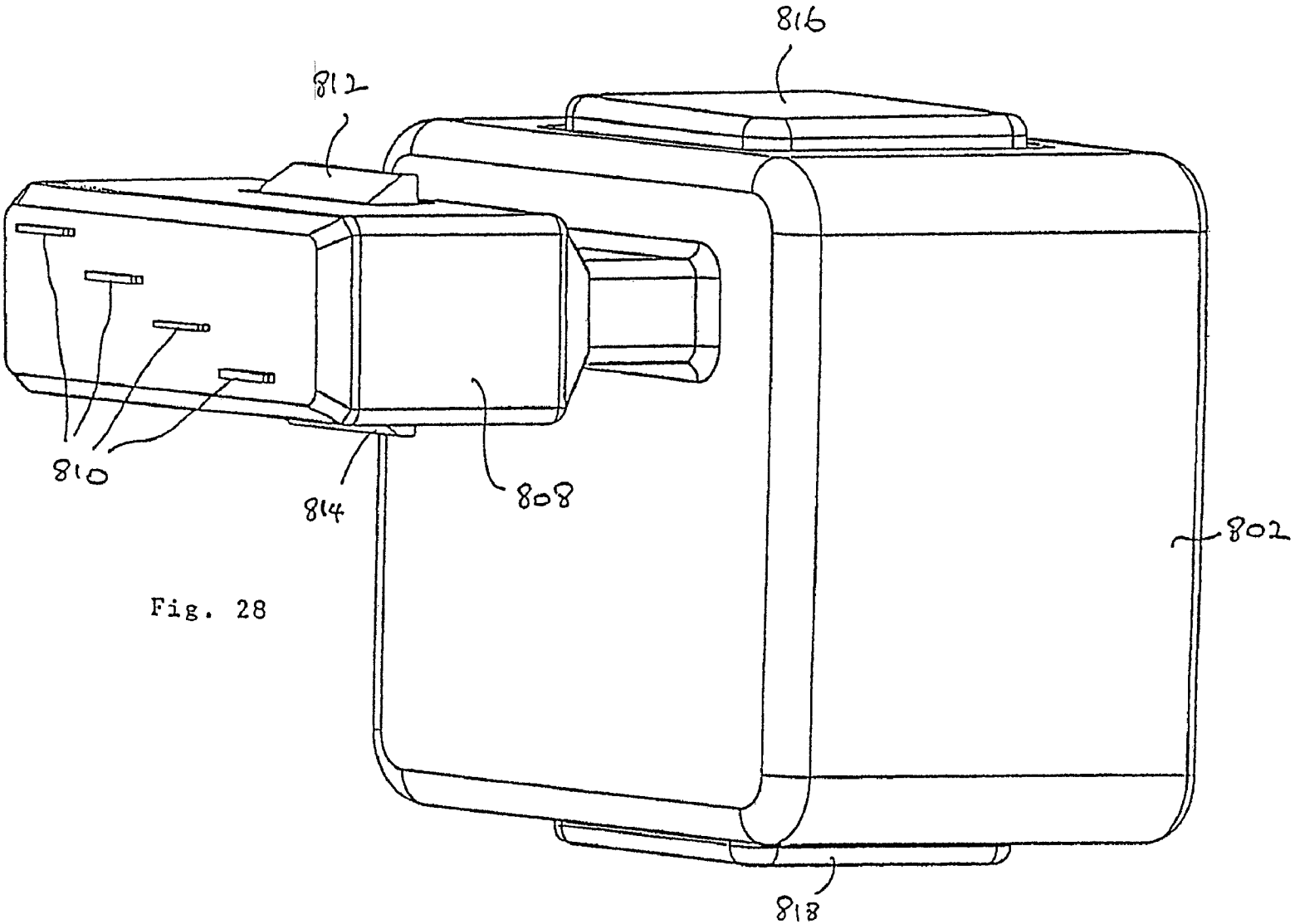
FIG. 28 shows a rear perspective view of the data and/or communications connector of FIG. 27.
Figure 29:
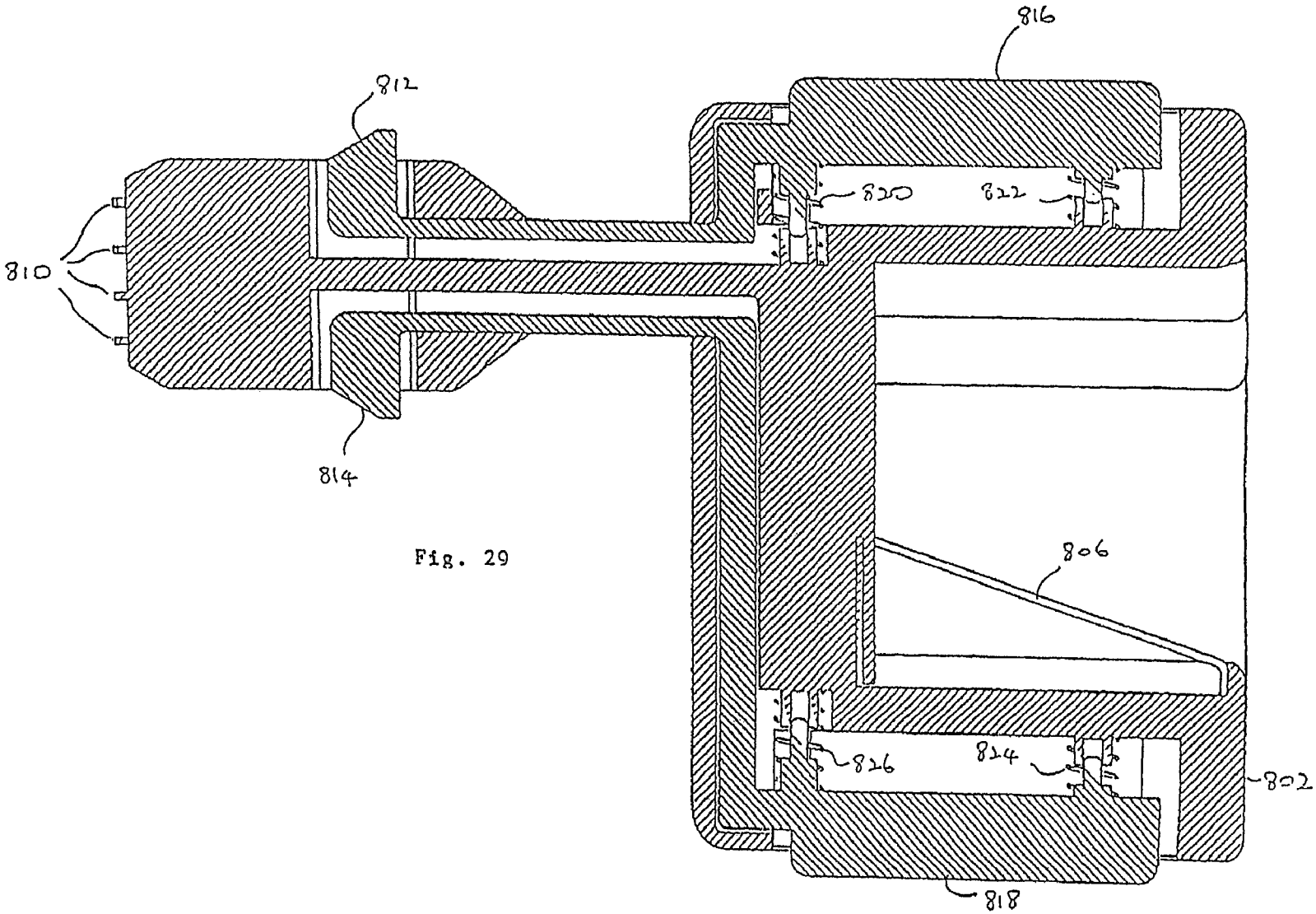
FIG. 29 shows a cross-sectional view of the data and/or communications connector of FIG. 27.

FIGS. 27 to 29 show different views of a data and/or communications connector in the form of an adapter suitable for use with the track section of FIG. 25. A perspective front view of the adapter 800 is shown in FIG. 27 comprising a housing 802 having a central aperture 804 of conventional design to receive a corresponding plug (not shown), such as a telephone plug. In the aperture 804 are four identical conductors 806 slanted at a predetermined angle with ends of the conductors 806 between two adjacent inner walls of the aperture 804 to match corresponding contacts of a telephone plug.

At the other end of the adapter 800 extends a connecting portion 808, as shown more clearly in FIG. 28 arranged to be inserted into the cavity 2300 by pushing through the flaps 2316, 2318 of the cover 2130. The connecting portion 808 has an outward facing surface which projects four equidistantly spaced conductive contacts 810. Each of these contacts 810 are electrically connected to respective ones of the slanted conductors 806 disposed in the aperture 804. The connecting portion 808 also has two catches 812, 814 on opposing side surfaces for engaging the projecting elements 2304, 2306 of the track section 100 at edges 2326 and 2328 (see FIG. 25). Each catch 812, 814 is tapered towards the insertion direction to facilitate ease of entry pass the edges 2326, 2328. Each of the catches 812, 814 are also linked to respective catch release buttons 816, 818 disposed at the housing 802 as shown in FIG. 29. The buttons 816, 818 are disposed in opposite directions and sit on springs 820, 822, 824, 826 which bias the buttons 816, 818 in an outwardly protruding manner.

Figure 30:
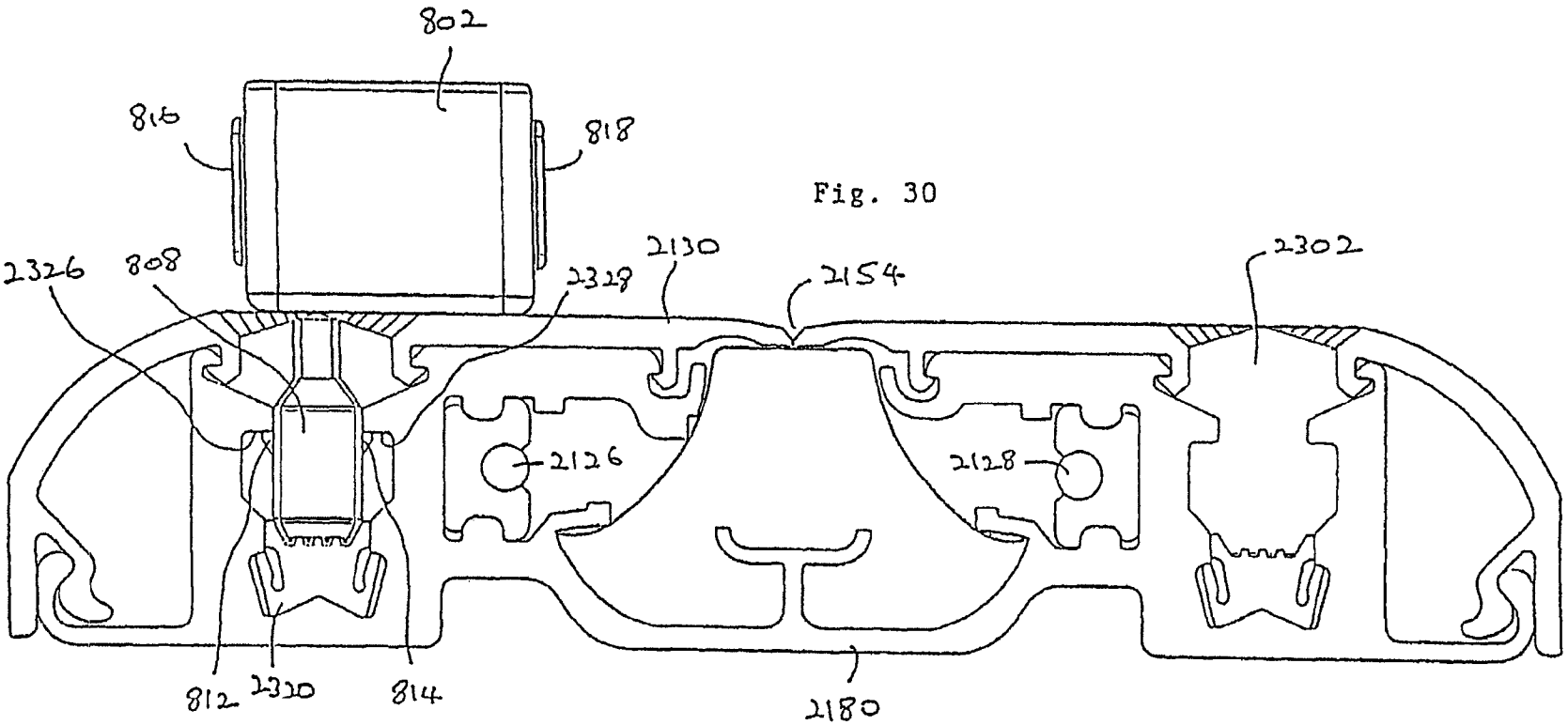
FIG. 30 shows a cross-sectional view of the data and/or communications connector of FIG. 27 connected to the track section of FIG. 25.

In use, the connecting portion 808 of the adapter 800 is pushed through flaps 2316, 2318 at any point along the slot 2131 and into the cavity 2300. The edges 2326, 2328 of the projecting elements 2304, 2306 of the track section 100 act on the tapered surfaces of the catches 812, 814 facilitating the movement inwards and subsequently locking the connecting portion 808 in place when the catches 812, 814 are free to be biased outwards, as shown in FIG. 30. In this position, the contacts 810 are received in the grooves 2324 and electrically connected to the conductors 2322. Preferably, each contact 810 is resiliently biased and the protrusion distance is such that when contact is made with each conductor 2322, the resiliently biased contact 810 engages the conductor 2322 to give a pressing electrical contact. If a communications equipment, for example a telephone, is connected at the other end of the adapter 800, the equipment would be able to receive voice or data signals in a conventional way with the added flexibility of being connected at any point along the slot 2131. To withdraw the adapter 800 from the cavity 2300, both buttons 816, 818 are depressed against the springs 820, 822, 824, 826 which retract the corresponding catches 812, 814 within the connecting portion 808 so that the catches 812, 814 are free from the edges 2326, 2328. In this way, the connecting portion 808 can be withdrawn from the cavity 2300.

Figure 31:
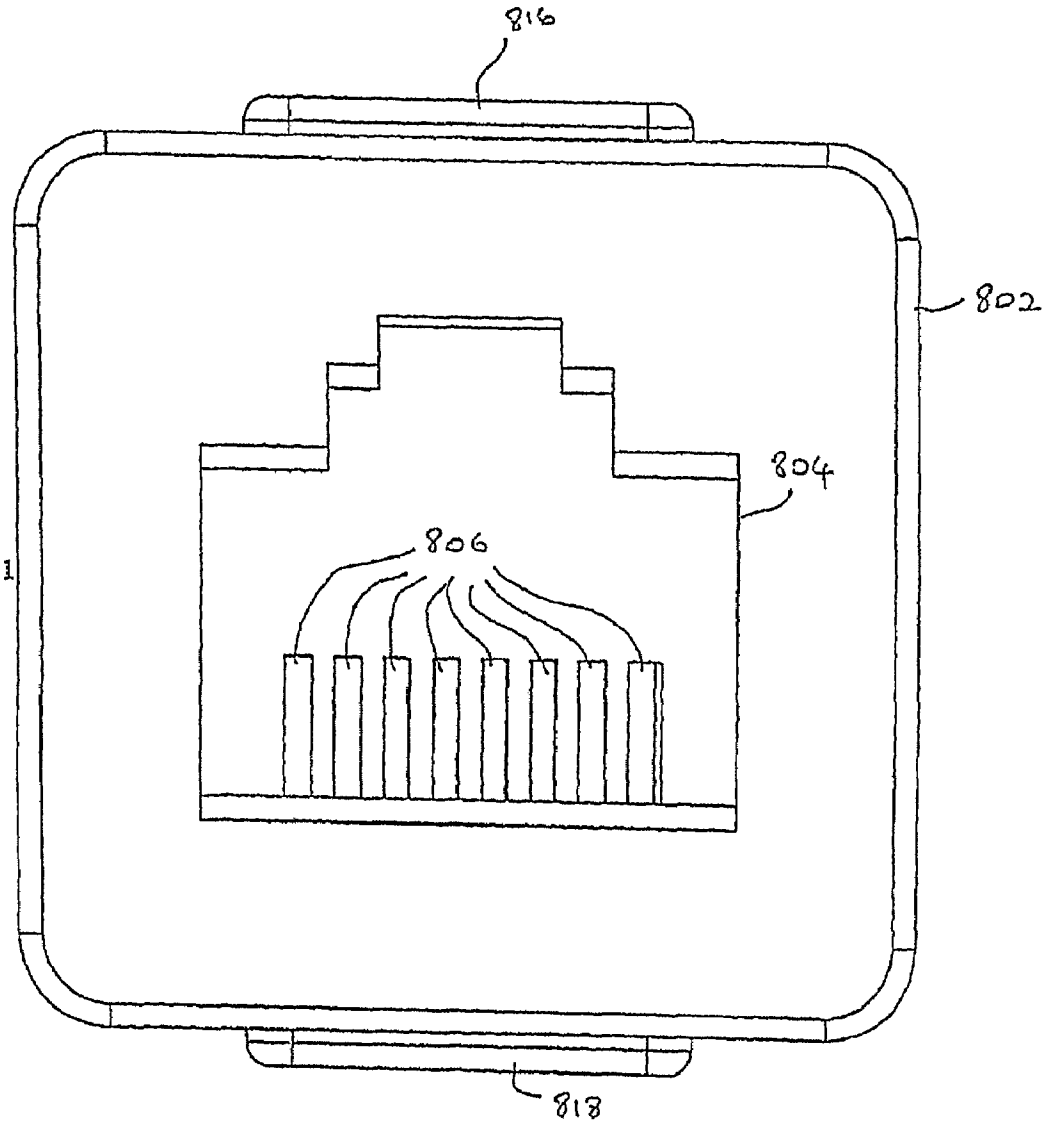
FIG. 31 shows a front view of a variation of the data and/or communications connector of FIG. 27.

It should be apparent that the number of conductors 2322 that is carried by the tray 2320 which typically corresponds to the number of contacts 810 varies depending on application. For example, for data communications applications such as Ethernet, eight wires are necessary to carry control and data signals and thus the adapter 800 will have eight slanted connectors 806 as shown in FIG. 31. Accordingly, the connecting portion 808 will have eight spaced contacts 810 and similarly, the tray 2320 will carry eight conductors 2322 to adhere to the communications protocol.

In a further variation, cavities 2300, 2302 may receive a different number of conductors 2322. For example, the first cavity 2300 may be used to support voice communications and four conductors 2322 are provided therein. On the other hand, the second cavity 2303 may provide eight conductors 2322 to meet the Ethernet protocol as described above. The track section 100 may also be adapted to provide one or more elongate slots 2131 just to support data or communication signals without the main slot 2154 for distributing electrical power.

Figure 32:
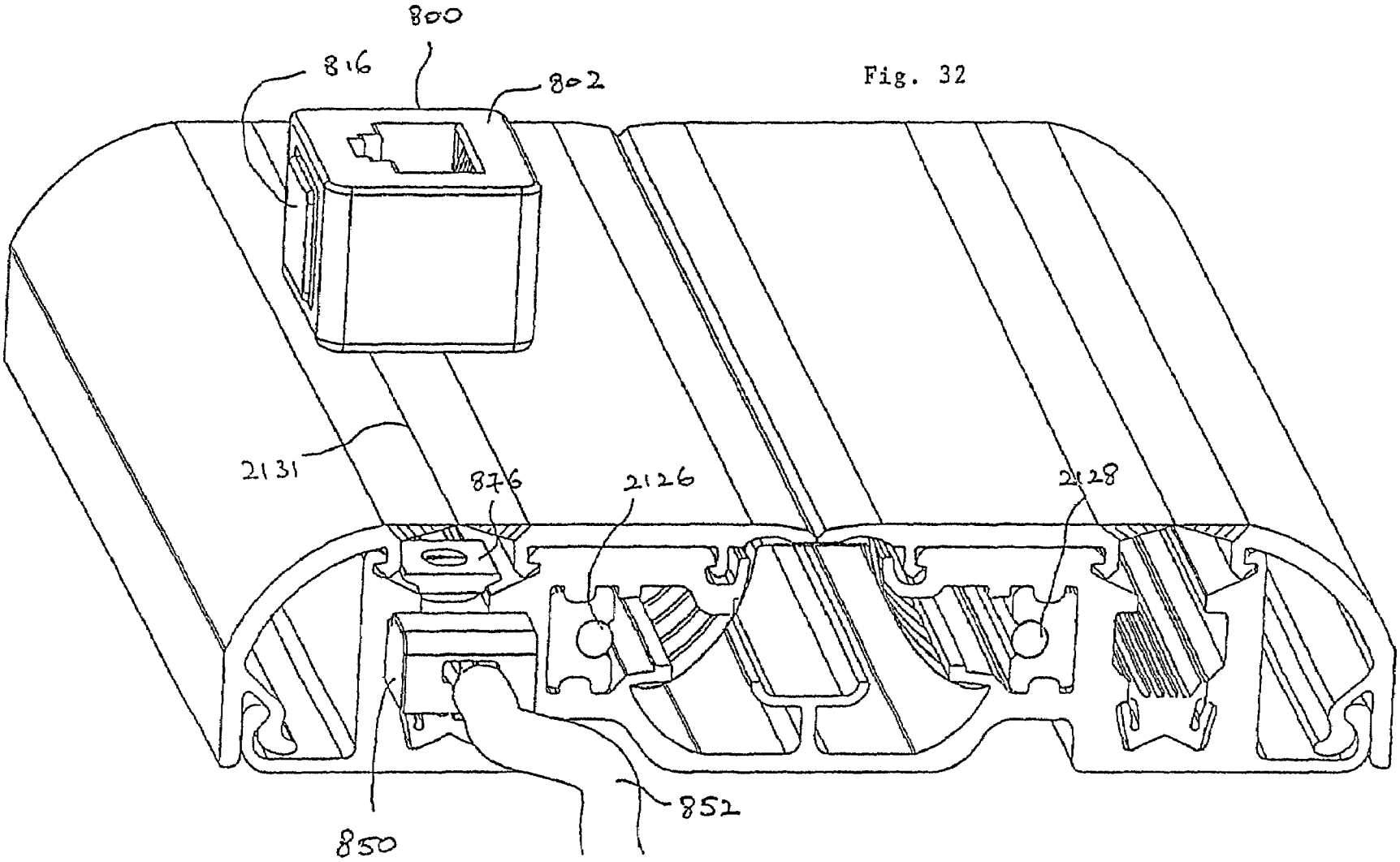
FIG. 32 shows a perspective view of the track section of FIG. 25 connected to a data and/or communications connector and terminal connector.

FIG. 32 shows a perspective view of the track section 100 of FIG. 30 with an adapter 800 inserted at a point along the slot 2131 to engage the elongate data conductors 2322 and a data and/or communications terminal connector being arranged to slidably engage an end of the data conductors 2322. The terminal connector 850 thus acts as an interface which links the conductors 2322 to a data communications cable 852 carrying a number of electrical wires providing communication signals.

Figure 33:
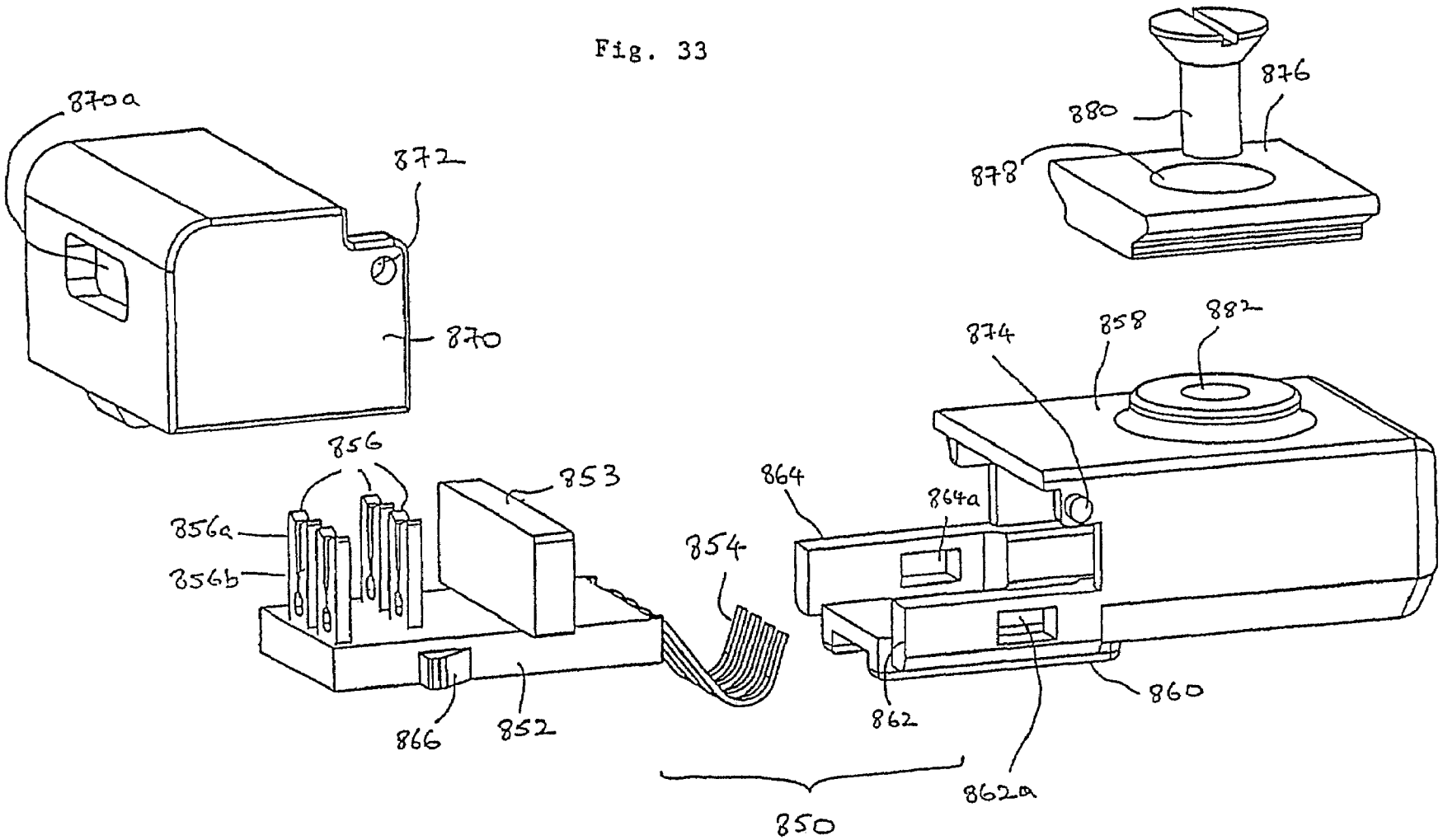
FIG. 33 shows an exploded view of the data and/or communications terminal connector of FIG. 32.

FIG. 33 shows an exploded perspective view of the terminal connector 850 which comprises a tray member 852 having four spaced U-shaped terminals 854 extending from one end. At the other end of the tray member 852 are four spaced wire contacts 856 which are electrically connected to the respective U-shaped terminals 854 and which extends upwards from the tray member 852. Each wire contact 856 has two arms **856*a*, 856*b* which co-act to hold an electrical wire therebetween. Situated between the terminals 854 and the contacts 856 is a rectangular formation 853 for engagement by a screw 880 to hold the tray member 852** in place which will be described in more detail later.

Figure 34:
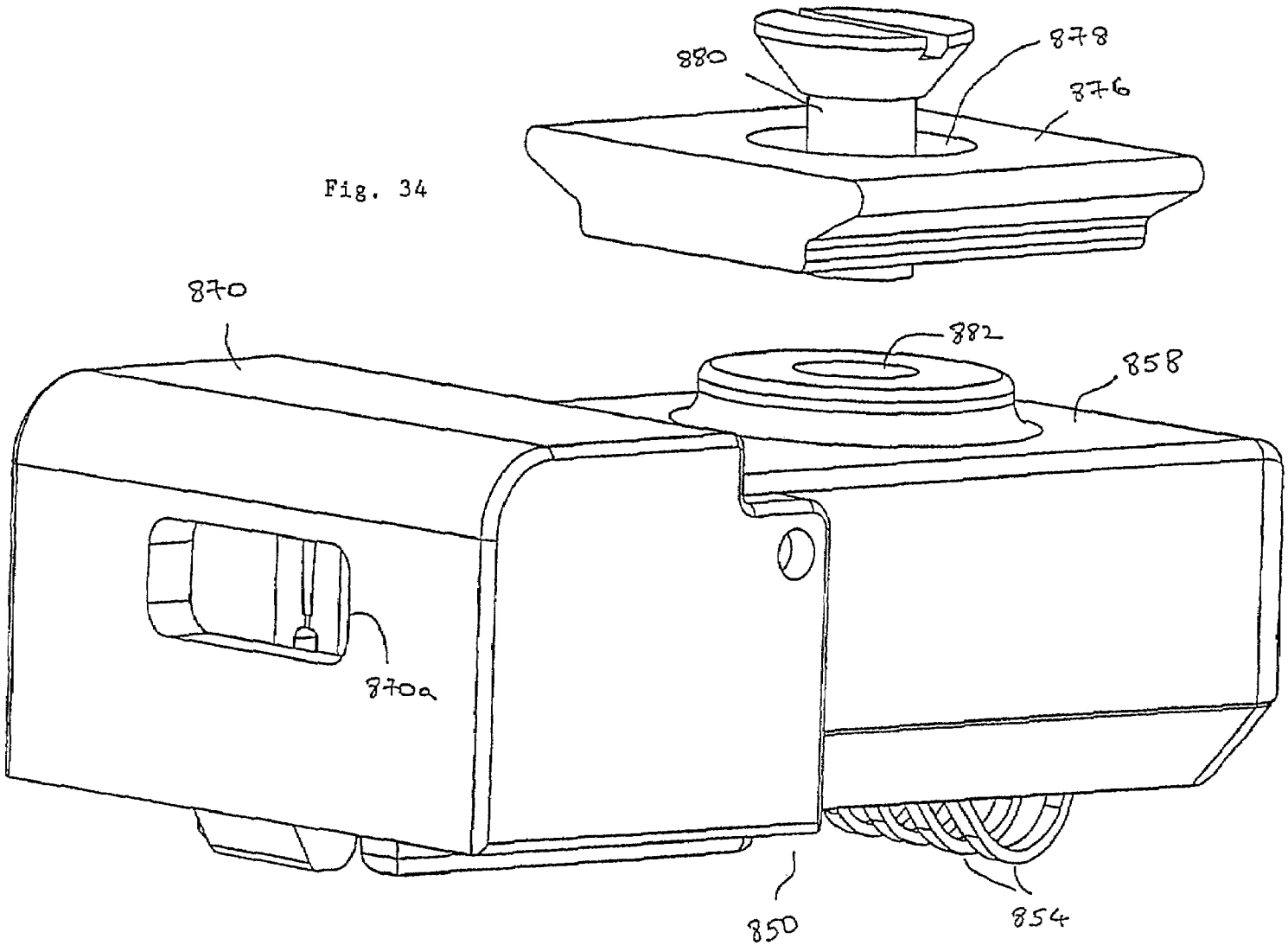
FIG. 34 shows an assembled view of the terminal connector of FIG. 32.

Part of the tray member 852 is received inside a corresponding housing 858 with a base 860 to support the tray member 852 and two opposing side supports 862, 864 connected to the base 860. Each side support 862, 864 has a rectangular aperture **862*a*, 864*a* formed therein for locking with two catches 866, 868 (the catch represented by reference numeral 868 is not shown) located on the sides of the tray member 852. The base 860 extends only part of the housing 858 such that when the tray member 852 is received inside the housing 858, the four terminals 854 protrude out of the housing 858 as shown in FIG. 34, which depicts a side perspective view of an assembled interface connector 850. The four wire contacts 856** would thus be exposed outside of the housing 858 which facilitates connecting the wire contacts 856 to the wires carried by the communication cable 852.

The terminal connector 850 further comprises an auxiliary cover 870 for covering the four wire contacts 856. As shown in FIGS. 33 and 34, the auxiliary cover 870 has a rectangular opening 870*a* through which the communication cable 852 is inserted (see FIG. 32) so that the electrical wires within can be connected to the wire contacts 856. The auxiliary cover 870 has two side lug holes 872 which are used for coupling the cover 870 to the corresponding lugs 874 located on the housing 858.

After the electrical wires of the communication cable 852 are properly connected to the wire contacts 856 and the cover 870 secured to the housing 858, the interface connector 850 is then inserted into one of the two cavities 2300, 2302 (see FIG. 32) carrying the data conductors 2322 so that each U-shaped terminal's apex engages respective ones of the data conductors 2322. In this way, when an adapter 800 is inserted anywhere along the slot 2131, communication signals carried by the communication cable 852 is transmitted to the adapter 800 via the U-shaped terminals 854 and the conductors 2322.

Preferably, to hold the terminal connector 850 in place in the cavity 2130, a coupling element 876 is used to couple the interface connector 850 to the edges 2326, 2328 of the track section 100. The coupling element 876 has a centre countersink hole 878 through which the head of the countersunk screw 880 sits. To engage the edges 2326, 2328 of the cavity 2300, the sides of the coupling element 876 are tapered at an angle to match the slope of the edges 2326, 2328 so that when the interface connector 850 is inserted into the cavity 2300, the two tapered sides of the coupling element 876 sit on respective edges 2326, 2328 and the countersunk screw 876 engages the formation 853 via a hole 882 on the top side of the housing 858. In this way, when the screw 880 is tightened, pressure is asserted on the coupling element 876 and onto the edges 2326, 2328 to hold the interface connector 850 in place.

FIG. 32 shows the connector 850 being secured to the track section 100 using the coupling element 876 and the screw 880. In this way, communication signals are distributed via the connector 850, the data conductors 2324 and finally to the data connector 800 and vice versa.

Preferably, the connector 850 is also housed in the housing 3000 of the connector of FIG. 19*a*/19*b*. In this case, the top cover 3100 of the housing 3000 has two further openings 3114, 3116, one on each side of the snap-off section 3106. Each opening 3114, 3116 is positioned to allow the communication cable 852 to pass through.

The described embodiments of the track section may be particularly used as a fixed power distribution apparatus, with the combination of track sections and connectors as shown in FIG. 1 being connected to a suitable supporting surface, such as a wall or movable partition or furniture item. However, the described embodiments may also be used in a movable manner, for example as an extension cable, with a single track section being provided with two end connectors, one end connector being connected to a cable having a suitable plug at its free end, in the manner of a normal extension cable. One or more power point connectors may then be attached to the track section according to need.

The invention claimed is:

1. An electrical plug having first and second electrical contacts arranged to engage corresponding conductors of an electrical power supply distribution apparatus, wherein the contacts are disposed at opposed ends of an arm rotatable between a first position in which the contacts are arranged to disengage from the conductors and a second position in which the contacts are arranged to engage with the conductors; and wherein the electrical plug further comprises an arm protector arranged to protect the arm in the first position.

2. An electrical plug as claimed in claim 1 wherein the contacts are resiliently displaceable.

3. An electrical plug as claimed in claim 1, wherein each contact is connected electrically to a said electrical wire.

4. An electrical plug as claimed in claim 1 wherein the ends of the arm are resiliently displaceable.

5. An electrical plug as claimed in claim 4 wherein each end is of hooked form.

6. An electrical plug as claimed in claim 1, wherein the plug is configured to allow engagement of each contact only with a selected conductor.

7. An electrical plug as claimed in claim 6, wherein the plug comprises a formation offset relative to the axis of rotation of the arm to allow the engagement of each contact only with the selected conductor.

* * * * *